US011158261B2

(12) United States Patent
Kim et al.

(10) Patent No.: US 11,158,261 B2
(45) Date of Patent: Oct. 26, 2021

(54) DISPLAY DEVICE AND METHOD OF DRIVING THE SAME

(71) Applicant: Samsung Display Co., Ltd., Yongin-si (KR)

(72) Inventors: Keun Woo Kim, Yongin-si (KR); Mee Jae Kang, Yongin-si (KR); Hye Na Kwak, Yongin-si (KR); Han Bit Kim, Yongin-si (KR); Thanh Tien Nguyen, Yongin-si (KR); Yong Su Lee, Yongin-si (KR); Jae Seob Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/852,848

(22) Filed: Apr. 20, 2020

(65) Prior Publication Data

US 2021/0049958 A1 Feb. 18, 2021

(30) Foreign Application Priority Data

Aug. 12, 2019 (KR) ..... 10-2019-0098379

(51) Int. Cl.
*G09G 3/325* (2016.01)
*G09G 3/3283* (2016.01)
*G09G 3/3266* (2016.01)

(52) U.S. Cl.
CPC ..... *G09G 3/325* (2013.01); *G09G 3/3266* (2013.01); *G09G 3/3283* (2013.01); *G09G 2320/064* (2013.01)

(58) Field of Classification Search
CPC ..... G09G 3/3266; G09G 2310/0283; G09G 2320/0693; G09G 2310/062;
(Continued)

(56) References Cited

U.S. PATENT DOCUMENTS 9,934,751 B2 4/2018 Kim
10,115,341 B2 10/2018 Kong et al.
(Continued)

FOREIGN PATENT DOCUMENTS

KR 10-2014-0078419 A 6/2014

OTHER PUBLICATIONS

Kim, Keunwoo et al., "Double-Gate CMOS: Symmetrical- Versus Asymmetrical-Gate Devices," IEEE Transactions on Electron Devices, vol. 48, No. 2, Feb. 2001, pp. 294-299.

*Primary Examiner* — Md Saiful A Siddiqui
(74) *Attorney, Agent, or Firm* — Lewis Roca Rothgerber Christie LLP

(57) ABSTRACT

A display device includes: a pixel including: a light emitting element connected between a first power source and a second power source; a first transistor connected between the first power source and the light emitting element to control a driving current, and including a first gate electrode connected to a first node and a second gate electrode connected to a bias control line; and a switching transistor connected between a data line and the first node, and including a gate electrode connected to a scan line; and a driving circuit to drive the pixel according to a driving frequency. The driving circuit drives the pixel in a first mode when the driving frequency is in a first range, and sequentially supplies a control signal having a first voltage and a second voltage to the bias control line during a light emission period of the pixel in the first mode.

20 Claims, 11 Drawing Sheets

(58) Field of Classification Search
CPC ..... G09G 2320/0233; G09G 3/325; G09G 3/3283; G09G 2320/064; G09G 3/3258; G09G 3/2092; G09G 3/3291
See application file for complete search history.

(56) References Cited

U.S. PATENT DOCUMENTS

| | | | | |
|---|---|---|---|---|
| 2016/0042694 | A1* | 2/2016 | Lim | G09G 3/3233 345/78 |
| 2018/0075808 | A1* | 3/2018 | Yamashita | G09G 3/3266 |
| 2019/0096330 | A1* | 3/2019 | Kim | G09G 3/3266 |

* cited by examiner

FIG. 12

LUT

| FREQUENCY / TIME (s) | 30Hz | 15Hz | 10Hz | 7.5Hz | 6Hz | 5Hz | 1Hz |
|---|---|---|---|---|---|---|---|
| 0.0167 | 6.995[V] | 6.995[V] | 6.995[V] | 6.995[V] | 6.995[V] | 6.995[V] | 6.995[V] |
| 0.0334 | 7.000[V] | 6.990[V] | 6.990[V] | 6.990[V] | 6.990[V] | 6.990[V] | 6.990[V] |
| 0.0501 | – | 6.985[V] | 6.985[V] | 6.985[V] | 6.985[V] | 6.985[V] | 6.985[V] |
| 0.0668 | – | 7.000[V] | 6.980[V] | 6.980[V] | 6.980[V] | 6.980[V] | 6.980[V] |
| 0.0835 | – | – | 6.975[V] | 6.975[V] | 6.975[V] | 6.975[V] | 6.975[V] |
| 0.1002 | – | – | 7.000[V] | 6.970[V] | 6.970[V] | 6.970[V] | 6.970[V] |
| 0.1169 | – | – | – | 6.965[V] | 6.965[V] | 6.965[V] | 6.965[V] |
| 0.1336 | – | – | – | 7.000[V] | 6.960[V] | 6.960[V] | 6.960[V] |
| 0.1503 | – | – | – | – | 6.955[V] | 6.955[V] | 6.955[V] |
| 0.1670 | – | – | – | – | 7.000[V] | 6.950[V] | 6.950[V] |
| 0.1837 | – | – | – | – | – | 6.945[V] | 6.945[V] |
| 0.2004 | – | – | – | – | – | 7.000[V] | 6.940[V] |
| ⋮ | – | – | – | – | – | – | ⋮ |
| 0.9666 | – | – | – | – | – | – | 6.690[V] |
| 0.9833 | – | – | – | – | – | – | 6.695[V] |
| 1.000 | – | – | – | – | – | – | 7.000[V] |

FIG. 14

LUT'

| FREQUENCY / TIME (s) | 30Hz | 15Hz | 10Hz | 7.5Hz | 6Hz | 5Hz | 1Hz |
|---|---|---|---|---|---|---|---|
| 0.0167 | 6.995[V] | 6.995[V] | 6.995[V] | 6.995[V] | 6.995[V] | 6.995[V] | 6.995[V] |
| 0.0334 | 7.000[V] | 6.985[V] | 6.985[V] | 6.985[V] | 6.985[V] | 6.985[V] | 6.985[V] |
| 0.0501 | – | | | | | | |
| 0.0668 | – | 7.000[V] | 6.975[V] | 6.975[V] | 6.975[V] | 6.975[V] | 6.975[V] |
| 0.0835 | – | – | | | | | |
| 0.1002 | – | – | 7.000[V] | 6.965[V] | 6.965[V] | 6.965[V] | 6.965[V] |
| 0.1169 | – | – | – | | | | |
| 0.1336 | – | – | – | 7.000[V] | 6.955[V] | 6.955[V] | 6.955[V] |
| 0.1503 | – | – | – | – | | | |
| 0.1670 | – | – | – | – | 7.000[V] | 6.945[V] | 6.945[V] |
| 0.1837 | – | – | – | – | – | | |
| 0.2004 | – | – | – | – | – | 7.000[V] | 6.940[V] |
| ⋮ | – | – | – | – | – | – | ⋮ |
| 0.9666 | – | – | – | – | – | – | 6.695[V] |
| 0.9833 | – | – | – | – | – | – | |
| 1.000 | – | – | – | – | – | – | 7.000[V] |

DISPLAY DEVICE AND METHOD OF DRIVING THE SAME

CROSS-REFERENCE TO RELATED APPLICATION

This application claims priority to and the benefit of Korean Patent Application No. 10-2019-0098379, filed on Aug. 12, 2019, the disclosure of which is hereby incorporated by reference in its entirety.

BACKGROUND

1. Field

One or more embodiments of the invention relate to a display device and a method of driving the same.

2. Discussion of the Related Art

A display device displays an image using pixels that are disposed in a display area. The pixels are connected to respective scan lines and data lines, and may include a plurality of transistors. For example, a pixel of an active light emitting display device may include a light emitting element, a driving transistor, and at least one switching transistor.

In order to express a desired luminance in the pixels during a light emission period of each frame, a gate voltage of the driving transistor should be stably maintained. However, a leakage current occurs in the pixel due to characteristics of the transistors, and thus, the gate voltage of the driving transistor may vary (or may be changed). Therefore, the desired luminance may not be sufficiently expressed in the pixel during each light emission period.

The above information disclosed in this Background section is for enhancement of understanding of the background of the invention, and therefore, it may contain information that does not constitute prior art.

SUMMARY

One or more embodiments of the invention are directed to a display device capable of maintaining or substantially maintaining (e.g., uniformly maintaining) a luminance of a pixel during a light emission period (e.g., during each light emission period) and a method of driving the same.

According to an embodiment of the present invention, a display device includes: a pixel at a display area, the pixel including: a light emitting element connected between a first power source and a second power source; a first transistor connected between the first power source and the light emitting element to control a driving current, the first transistor including a first gate electrode connected to a first node and a second gate electrode connected to a bias control line; and at least one switching transistor connected between a data line and the first node, the at least one switching transistor including a gate electrode connected to a scan line; and a driving circuit configured to drive the pixel according to a driving frequency. The driving circuit is configured to drive the pixel in a first mode when the driving frequency is in a first range, and to sequentially supply a control signal having a first voltage and a second voltage to the bias control line during a light emission period of the pixel in the first mode.

In an embodiment, the driving circuit may be configured to divide the light emission period of the pixel into a plurality of sub light emission periods including a first sub light emission period and a second sub light emission period when in the first mode, and to supply controls signals having different voltages to the bias control line during each of the sub light emission periods.

In an embodiment, the first transistor may be a P-type transistor, and the driving circuit may be configured to decrease the voltage of the control signal stepwise, and to supply the control signal to the bias control line corresponding to the sub light emission periods.

In an embodiment, the first range may include a plurality of driving frequencies, and the driving circuit may be configured to divide the light emission period of the pixel into a different number of sub light emission periods for each of the driving frequencies of the first range, and to change the voltage of the control signal stepwise corresponding to the sub light emission periods.

In an embodiment, the driving circuit may include a lookup table to store voltage information of the control signal for each of the driving frequencies.

In an embodiment, the driving circuit may be configured to increase or decrease the voltage of the control signal by a voltage amount stepwise, and to supply the control signal to the bias control line corresponding to the sub light emission periods.

In an embodiment, at least one of the sub light emission periods may have a duration that is longer than that of at least one other remaining sub light emission periods, and the driving circuit may be configured to change the voltage of the control signal at a start time of the at least one of the sub light emission periods to have an amplitude that is greater than that of the control signal at a start time of the at least one other remaining sub light emission periods.

In an embodiment, the first range may include a frequency that is less than 60 Hz.

In an embodiment, the driving circuit may be configured to drive the pixel in a second mode when the driving frequency is in a second range that is greater than the first range, and to supply a control signal having a constant voltage to the bias control line when in the second mode.

In an embodiment, the second range may include a frequency that is greater than or equal to 60 Hz.

In an embodiment, the display area may include: a plurality of scan lines; a plurality of bias control lines; a plurality of data lines; and a plurality of pixels connected to the scan lines, the bias control lines, and the data lines; and the driving circuit may include: a scan driver to supply a scan signal to the scan lines; a control line driver to supply a control signal to the bias control lines; a data driver to supply a data signal to the data lines; and a timing controller to control the scan driver, the control line driver, and the data driver.

In an embodiment, the bias control lines may be commonly connected to pixels of each horizontal line.

In an embodiment, the control line driver may be configured to sequentially supply the control signal having the first voltage and the second voltage to the bias control lines connected to the pixels during the light emission period of the pixels of each horizontal line in the first mode.

In an embodiment, the timing controller may be configured to divide the light emission period of the pixels into a plurality of sub light emission periods when in the first mode, and to control the control line driver to change the voltage of the control signal corresponding to the sub light emission periods.

According to an embodiment of the present invention, a method of driving a display device including a pixel including a driving transistor having a dual gate structure is provided. The method includes: determining a driving frequency of the pixel; and driving the pixel in a first mode when the driving frequency is in a first range. The driving of the pixel in the first mode includes: supplying a data signal to a first gate electrode of the driving transistor; and illuminating the pixel according to a voltage applied to the first gate electrode of the driving transistor while sequentially supplying a control signal having a first voltage and a second voltage to a second gate electrode of the driving transistor.

In an embodiment, the first range may include a frequency that is less than 60 Hz.

In an embodiment, the first range may include a plurality of driving frequencies, a light emission period of the pixel may be divided into a different number of sub light emission periods for each of the driving frequencies of the first range, and the voltage of the control signal may be changed stepwise corresponding to the sub light emission periods.

In an embodiment, the light emission period of the pixel may be divided into a greater number of sub light emission periods as the light emission period according to each of the driving frequencies is increased.

In an embodiment, the method may further include: supplying the control signal having a constant voltage to the second gate electrode of the driving transistor during a light emission period of the pixel when the driving frequency is in a second range that is greater than the first range.

In an embodiment, the second range may include a frequency that is greater than or equal to 60 Hz.

According to one or more embodiments of the present invention of the display device and the method of driving the same, the pixel may be driven at a frequency of a suitable range (e.g., a predetermined range). In addition, the luminance of the pixel may be maintained or substantially maintained (e.g., uniformly maintained) during each light emission period.

BRIEF DESCRIPTION OF THE FIGURES

The above and other aspects and features of the present invention will become more apparent to those skilled in the art from the following detailed description of the example embodiments with reference to the accompanying drawings.

FIG. 12 is a lookup table LUT illustrating a voltage change of a control signal according to a frequency of a first range, in accordance with an embodiment of the invention.

FIG. 14 is a lookup table LUT illustrating a voltage change of a control signal according to a frequency of a first range, in accordance with an embodiment of the invention.

DETAILED DESCRIPTION

Figure 1:
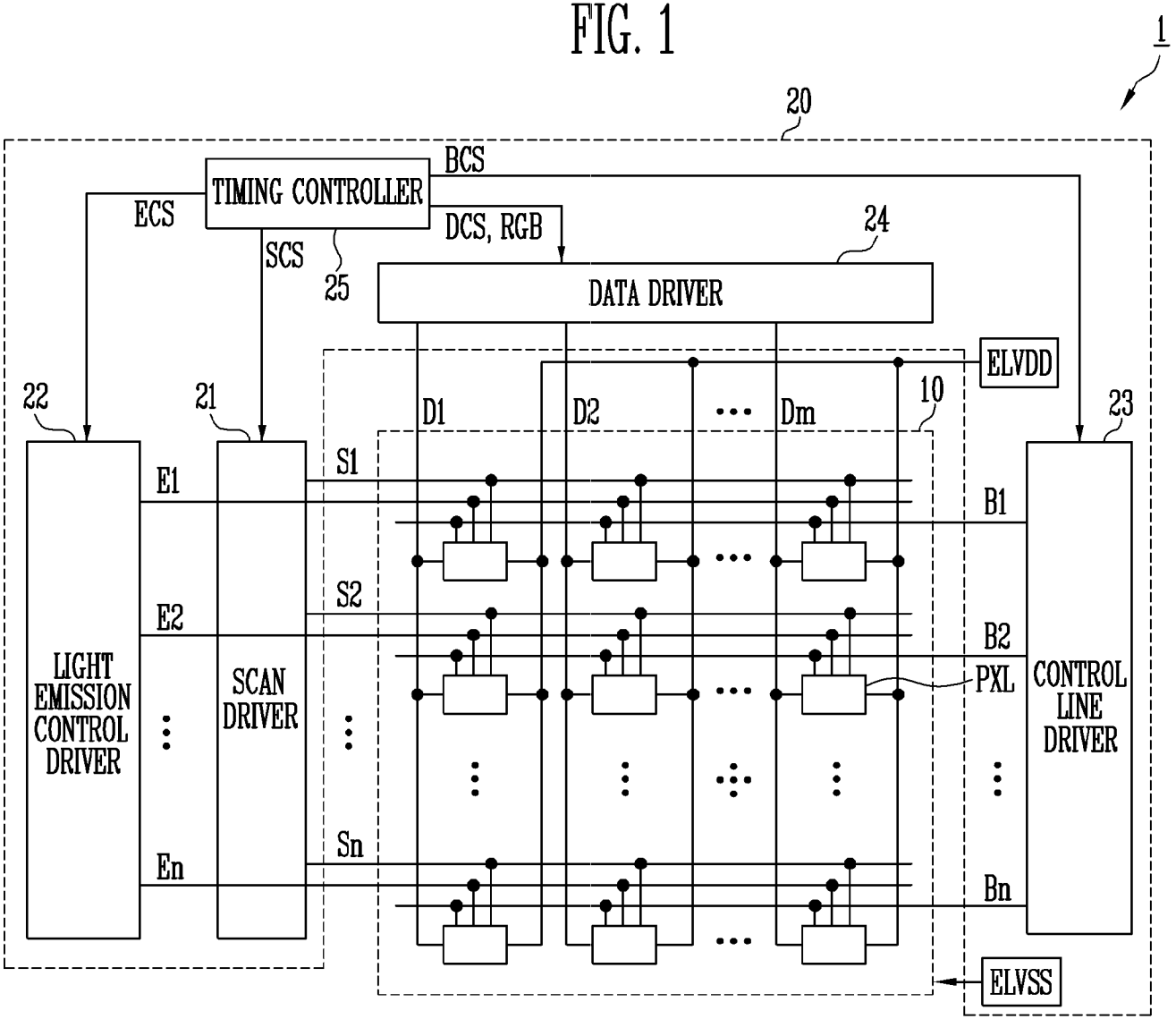
FIG. 1 is a schematic diagram illustrating a display device according to an embodiment of the invention.

Hereinafter, example embodiments will be described in more detail with reference to the accompanying drawings, in which like reference symbols refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference symbols denote like elements throughout the attached drawings and the written description, even if shown in different drawings, and thus, redundant descriptions thereof may not be repeated.

Descriptions of features or aspects within each example embodiment should typically be considered as available for other similar features or aspects in other example embodiments. For example, each of the embodiments disclosed below may be implemented alone or in combination with at least one of other embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a schematic diagram illustrating a display device 1 according to an embodiment of the invention. Although FIG. 1 shows a light emitting display device including light emitting elements as an example of the display device 1, the invention is not limited thereto.

Referring to FIG. 1, the display device 1 according to an embodiment of the invention may include a plurality of pixels PXL disposed at (e.g., in or on) a display area 10, and a driving circuit 20 for driving the pixels PXL.

The display area 10 includes a plurality of scan lines S1 to Sn (where n is a natural number), a plurality of light emission control lines E1 to En, a plurality of bias control lines B1 to Bn, a plurality of data lines D1 to Dm (where m is a natural number), and the pixels PXL connected to the scan lines S1 to Sn, the light emission control lines E1 to En, the bias control lines B1 to Bn, and the data lines D1 to Dm. As used herein, the term "connection" may comprehensively refer to an electrical connection and/or a physical connection. For example, the pixels PXL may be electrically connected to the scan lines S1 to Sn, the light emission control lines E1 to En, the bias control lines B1 to Bn, and the data lines D1 to Dm.

According to an embodiment, each of the scan lines S1 to Sn, the light emission control lines E1 to En, and the bias control lines B1 to Bn may extend along a first direction (also referred to as a "row direction" or a "horizontal direction") at (e.g., in or on) the display area 10, and may be connected (e.g., commonly connected) to the pixels PXL positioned at each horizontal line (also referred to as a "pixel row"). In addition, each of the data lines D1 to Dm may extend along a second direction (also referred to as a "column direction" or a "vertical direction") at (e.g., in or on) the display area 10 to cross the scan lines S1 to Sn, the light emission control lines E1 to En, and the bias control lines B1 to Bn, and may be connected (e.g., commonly connected) to the pixels PXL positioned at each vertical line (also referred to as a "pixel column").

However, the invention is not limited thereto, and according to an embodiment, the light emission control lines E1 to En may be omitted. For example, the light emission control lines E1 to En may be selectively provided according to (e.g., depending on or based on) a structure and/or a driving method of the pixels PXL. In addition, according to an embodiment, the pixels PXL may be further connected to at least one of other control lines, and an operation of the pixels PXL may be controlled by a control signal supplied from the other control lines.

The pixels PXL receive a scan signal, a light emission control signal, a control signal having a suitable voltage or a predetermined voltage (also referred to as a "bias control signal", a "back-bias voltage", a "second gate signal", or a "second gate voltage"), and a data signal from the scan lines S1 to Sn, the light emission control lines E1 to En, the bias control lines B1 to Bn, and the data lines D1 to Dm, respectively. In addition, the pixels PXL further receive driving power, for example, such as from a first power source ELVDD and a second power source ELVSS. In some embodiments, the pixels PXL may further receive another driving power (e.g., an initialization power) according to (e.g., depending on or based on) a structure and/or a driving method of the pixels PXL.

The pixels PXL receive respective data signals from the data lines D1 to Dm when respective scan signals are supplied from the scan lines S1 to Sn, and emit light having a luminance corresponding to the data signals. Therefore, an image corresponding to the data signal of each frame is displayed at (e.g., in or on) the display area 10.

In an embodiment, a light emission period of the pixels PXL may be controlled by respective emission control signals that are supplied from the light emission control lines E1 to En. In addition, a driving current that flows through the pixels PXL may be controlled by the control signal supplied from the bias control lines B1 to Bn, in addition to the data signal supplied from the data lines D1 to Dm.

Each pixel PXL may include a light emitting element and a pixel circuit for driving the light emitting element. The pixel circuit controls the driving current that flows from the first power source ELVDD to the second power source ELVSS in correspondence with the data signal. For example, the pixel circuit may include a driving transistor, at least one switching transistor, and a storage capacitor.

The driving circuit 20 may include a plurality of drivers for supplying driving signals to the pixels PXL. For example, the driving circuit 20 may include a scan driver 21 for supplying the scan signals to the scan lines S1 to Sn, a light emission control driver 22 for supplying the light emission control signals to the light emission control lines E1 to En, a control line driver 23 for supplying the control signals having the suitable voltage (e.g., a predetermined voltage) to the bias control lines B1 to Bn, a data driver 24 for supplying the data signals to the data lines D1 to Dm, and a timing controller 25 for controlling the scan driver 21, the light emission control driver 22, the control line driver 23, and the data driver 24.

The scan driver 21 receives a scan driving control signal SCS from the timing controller 25, and supplies the scan signals to the scan lines S1 to Sn in correspondence with the scan driving control signal SCS. For example, the scan driver 21 may sequentially supply the scan signals to the scan lines S1 to Sn in correspondence with the scan driving control signal SCS. When a scan signal is supplied to a corresponding one of the scan lines S1 to Sn, the pixels PXL connected to the corresponding scan line to which the scan signal is supplied are selected to receive corresponding data signals from the data lines D1 to Dm.

According to an embodiment, the scan signal may be used to select the pixels PXL in a horizontal line unit. For example, the scan signal may have a gate-on voltage (e.g., a low voltage) that may be supplied to the pixels PXL of a horizontal line corresponding to each horizontal period, such that a transistor of each pixel PXL of the horizontal line that is connected to the data lines D1 to Dm may be turned on. The pixels PXL that receive the scan signal may be connected to the data lines D1 to Dm to receive the respective data signals during the period in which the scan signal is supplied.

The light emission control driver 22 receives a light emission driving control signal ECS from the timing controller 25, and supplies the light emission control signals to the light emission control lines E1 to En in correspondence with the light emission driving control signal ECS. For example, the light emission control driver 22 may sequentially supply the light emission control signals to the light emission control lines E1 to En in correspondence with the light emission driving control signal ECS. However, the invention is not limited thereto, and in some embodiments, the light emission control driver 22 may be omitted. For example, the light emission control driver 22 may be selectively provided (or not provided) according to (e.g., depending on or based on) the structure and/or the driving method of the pixels PXL.

The light emission control signal may be used to control the light emission period (e.g., a light emission timing and/or a light emission duration) of the pixels PXL. For example, the light emission control signal may have a gate-off voltage (e.g., a high voltage) at which at least one transistor disposed on a current path of the pixel (e.g., each of the pixels) PXL may be turned off. In this case, the pixel PXL that receives the light emission control signal may be set to a non-light emission state during the period in which the light emission control signal is supplied, and may be set to a light emission state during another period (e.g., a period in which the light emission control signal is not supplied). On the other hand, when a data signal corresponding to a black grayscale (e.g., a black grayscale level) is supplied to a pixel PXL, the pixel PXL may maintain or substantially maintain the non-light emission state in correspondence with the data signal, even though the light emission control signal having the gate-off voltage is not supplied.

The control line driver 23 receives a bias driving control signal BCS from the timing controller 25, and supplies the control signal having the suitable voltage (e.g., having a predetermined voltage) to the bias control lines B1 to Bn in correspondence with the bias driving control signal BCS. For example, the control line driver 23 may sequentially supply the control signals having the suitable voltage and/or having a suitable waveform to the bias control lines B1 to Bn in correspondence with the bias driving control signal BCS. For example, the control line driver 23 may supply the control signals having the suitable voltage and/or the suitable waveform to the bias control lines B1 to Bn of the pixels PXL during the light emission period of the pixels PXL disposed at each horizontal line.

According to an embodiment, the control line driver 23 may supply control signals having different voltages and/or waveforms to the pixels PXL according to a driving frequency of the pixels PXL. For example, the control line driver 23 may supply a control signal to the pixels PXL that is maintained or substantially maintained at a suitable voltage or voltage level (e.g., a constant voltage or constant voltage level) during a light emission period of each frame with respect to a frequency that is greater than or equal to a reference frequency (e.g., a predetermined reference frequency), for example, such as a frequency that is greater than or equal to 60 Hz. The control line driver 123 may also supply a control signal to the pixels PXL having a suitable waveform in which a voltage is changed stepwise during the light emission period of each frame with respect to a frequency of a first range that is less than the reference frequency (e.g., a frequency that is less than 60 Hz).

In an embodiment, the control line driver 23 may include a voltage divider for generating voltages having various levels, or may include a plurality of switches connected to a plurality of voltage sources having voltages of different levels, to output the control signal having the waveform in which the voltage is changed stepwise. In another embodiment, the control line driver 23 may receive a start pulse and/or a clock signal of a step waveform from the timing controller 25, sequentially shift the start pulse and/or the clock signal, and output the shifted start pulse and/or clock signal to the bias control lines B1 to Bn. In addition, the control line driver 23 may be configured with circuits having various structures and/or driving methods.

The control signal output from the control line driver 23 may be used to control a characteristic of the driving transistor included in the pixels PXL. For example, the control signal may be supplied to a second gate electrode of the driving transistor included in the pixel (e.g., each pixel) PXL to control a threshold voltage of the driving transistor. When the threshold voltage of the driving transistor is changed using the control signal, a magnitude of a driving current generated by the driving transistor may be controlled with respect to the data signal (e.g., each data signal). Therefore, a luminance of the pixels PXL may be controlled by controlling the voltage of the control signal.

The data driver 24 receives the data driving control signal DCS and image data RGB from the timing controller 25, and supplies the data signals to the data lines D1 to Dm in correspondence with the data driving control signal DCS and the image data RGB. The data signals supplied to the data lines D1 to Dm are supplied to the pixels PXL that are selected by the respective scan signals.

The timing controller 25 receives various timing signals (e.g., a vertical/horizontal synchronization signal, a main clock signal, and/or the like) from the outside (e.g., from a host processor), and generates the scan driving control signal SCS, the light emission driving control signal ECS, the bias driving control signal BCS, and the data driving control signal DCS. The scan driving control signal SCS, the light emission driving control signal ECS, the bias driving control signal BCS, and the data driving control signal DCS are supplied to the scan driver 21, the light emission control driver 22, the control line driver 23, and the data driver 24, respectively.

The scan driving control signal SCS includes a first start pulse (e.g., a scan start pulse) and a first clock signal (e.g., at least one scan clock signal). The first start pulse controls an output timing of a first scan signal (e.g., a scan signal supplied to a first scan line S1), and the first clock signal is used to shift (e.g., sequentially shift) the first start pulse.

The light emission driving control signal ECS includes a second start pulse (e.g., a light emission start pulse) and a second clock signal (e.g., at least one light emission clock signal). The second start pulse controls an output timing of a first light emission control signal (e.g., a light emission control signal supplied to a first emission control line E1), and the second clock signal is used to shift (e.g., sequentially shift) the second start pulse.

The bias driving control signal BCS controls the control line driver 23 to output a control signal having a suitable waveform (e.g., a predetermined waveform) according to the driving frequency of the pixels PXL. For example, the bias driving control signal BCS includes a signal for controlling the control line driver 23 to output (e.g., continuously output) the control signal of the suitable voltage (e.g., the predetermined voltage) to the bias control lines B1 to Bn with respect to the frequency that is greater than or equal to the reference frequency (e.g., the predetermined reference frequency, for example, 60 Hz). In addition, the bias driving control signal BCS includes a signal for controlling the control line driver 23 to output (e.g., sequentially output) a control signal having a suitable waveform (e.g., a specific waveform), for example, such as a waveform having a step shape, to the bias control lines B1 to Bn during each light emission period with respect to the frequency that is less than the reference frequency. For example, when the control line driver 23 includes a shift register, the bias driving control signal BCS may include a third start pulse and a third clock signal for driving the shift register. The third start pulse controls an output timing of a first control signal (e.g., a control signal having a desired or specific waveform that is supplied to a first bias control line B1), and the third clock signal is used to shift (e.g., sequentially shift) the third start pulse.

The data driving control signal DCS includes a source sampling pulse, a source sampling clock, and a source output enable signal. The data driving control signal DCS controls a sampling operation of data (e.g., image data).

In addition, the timing controller 25 receives input image data from the outside, and rearranges the input image data to generate the image data RGB. The timing controller 25 supplies the image data RGB to the data driver 24. The image data RGB supplied to the data driver 24 is used to generate the data signal to be supplied to the pixels PXL.

In an embodiment of the invention, the driving circuit 20 drives the pixels PXL at a frequency of a suitable range (e.g., a predetermined range). For example, the driving circuit 20 may drive the pixels PXL at respective driving frequencies according to various driving signals (e.g., timing signals, and/or the like) that is input from a host processor and/or the like, and/or according to a suitable driving condition (e.g., a predetermined driving condition).

For example, the driving circuit 20 may drive the pixels PXL at a high speed (also referred to as "high frequency driving") at a driving frequency that is greater than or equal to the reference frequency (e.g., 60 Hz) when displaying a moving image. In addition, the driving circuit 20 may drive the pixels PXL at a low speed (also referred to as "low frequency driving") at a driving frequency that is less than the reference frequency (e.g., 60 Hz), for example, such as at 30 Hz or less, when displaying a still image (e.g., such as a standby screen) to reduce power consumption.

According to an embodiment, the driving circuit 20 distinguishes a frequency of a first range from a frequency of a second range based on the reference frequency (e.g., the predetermined reference frequency, for example, 60 Hz). The driving circuit 20 drives the pixels PXL using different driving methods with respect to the frequency of each of the first and second ranges.

For example, the driving circuit 20 drives the pixels PXL in a first mode with respect to the frequency of the first range, which is less than the reference frequency. In the first mode, the driving circuit 20 changes the voltage of the control signal that is supplied to the bias control line (e.g., any suitable one of the bias control lines B1 to Bn) connected to the pixels PXL at least once so that a uniform or substantially uniform driving current is provided (e.g., flows or continuously flows) during the light emission period of each pixel PXL. For example, the driving circuit 20 may supply a control signal having a step waveform that increases or decreases stepwise to the corresponding bias control line connected to the corresponding pixel PXL during the light emission period of the corresponding pixel (e.g., each pixel) PXL in correspondence with the first mode to compensate for a gate voltage variation of the driving transistor due to a leakage current.

On the other hand, the driving circuit 20 drives the pixels PXL in a second mode with respect to the frequency of the second range that is greater than or equal to the reference frequency. In the second mode, the driving circuit 20 maintains or substantially maintains the voltage of the control signal that is supplied to the bias control line (e.g., each bias control line) at a suitable voltage level (e.g., a constant voltage or a constant voltage level).

According to the above-described embodiment, even though the display device 1 is driven at a low frequency that is less than the reference frequency, the driving current of (e.g., flowing through) the pixels PXL may be maintained or substantially maintained (e.g., uniformly and/or continuously maintained) during the light emission period (e.g., during each light emission period). Therefore, image quality of the display device 1 may be improved by maintaining or substantially maintaining (e.g., uniformly maintaining) the luminance of the pixels PXL during the light emission period (e.g., during each light emission period), and/or reducing or preventing flicker (e.g., due to a luminance decrease).

Figure 2:
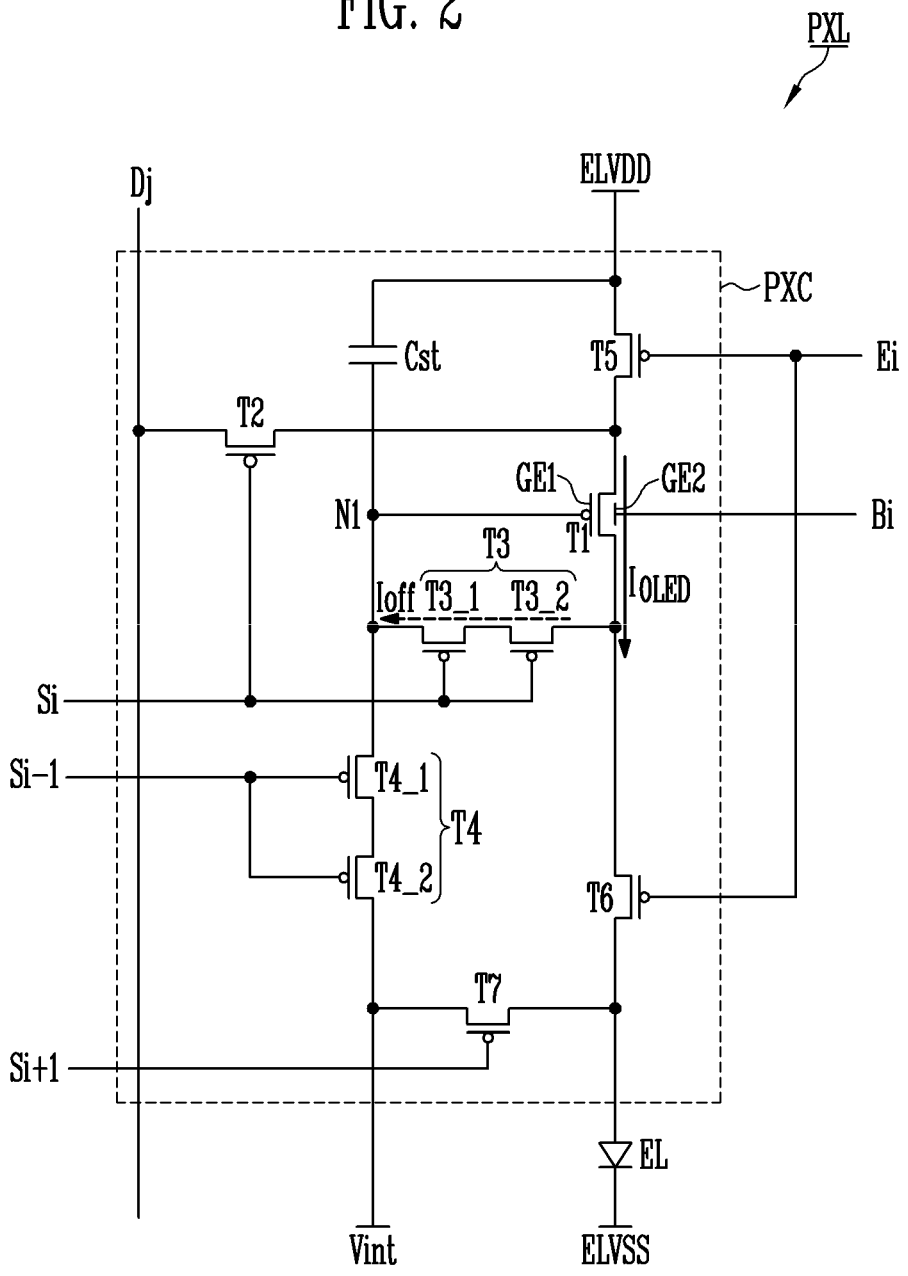
FIG. 2 is a circuit diagram illustrating a pixel according to an embodiment of the invention.

FIG. 2 is a circuit diagram illustrating a pixel PXL according to an embodiment of the invention. For example, FIG. 2 illustrates an embodiment of a pixel (e.g., a representative pixel) PXL that may be disposed at (e.g., in or on) the display area 10 of FIG. 1. The pixel PXL may be disposed at an i-th (i is a natural number) pixel row (e.g., an i-th horizontal line) and a j-th (j is a natural number) pixel column (e.g., a j-th vertical line) of the display area 10, and may be connected to an i-th scan line Si, an i-th light emission control line Ei, an i-th bias control line Bi, and a j-th data line Dj. In addition, the pixel PXL may be further selectively connected to at least one of other scan lines or control lines. For example, the pixel PXL may be further connected to an (i−1)-th scan line Si−1 and an (i+1)-th scan line Si+1 according to (e.g., depending on or based on) a structure and/or driving method of the pixel PXL.

According to an embodiment, the other pixels PXL disposed at (e.g., in or on) the display area 10 of FIG. 1 may have the same or substantially the same structure as that of the representative pixel PXL shown in FIG. 2. Hereinafter, the "i-th scan line Si", the "i-th light emission control line Ei", the "i-th bias control line Bi" and the "j-th data line Dj" may be referred to as a "scan line Si", a "light emission control line Ei", a "bias control line Bi", and a "data line Dj", respectively.

Referring to FIG. 2, the pixel PXL according to an embodiment of the invention includes a light emitting element EL and a pixel circuit PXC for driving the light emitting element EL. According to an embodiment, the light emitting element EL may be connected between the pixel circuit PXC and the second power source ELVSS, but a position of the light emitting element EL is not limited thereto. For example, in another embodiment, the light emitting element EL may be connected between the first power source ELVDD and the pixel circuit PXC.

According to an embodiment, the light emitting element EL may be an organic light emitting diode (OLED) including an organic light emitting layer, but is not limited thereto. For example, in another embodiment, one or more ultra-small inorganic light emitting elements that are as small as nano-scale to micro-scale may define (e.g., configure) a light source of a pixel (e.g., each pixel) PXL.

The light emitting element EL is connected between the first power source ELVDD and the second power source ELVSS. For example, an anode electrode of the light emitting element EL may be connected to the first power source ELVDD through the pixel circuit PXC, and a cathode electrode of the light emitting element EL may be connected to the second power source ELVSS. In another example, the anode of the electrode of the light emitting element EL may be connected to the first power source ELVDD, and the cathode electrode of the light emitting element EL may be connected to the second power source ELVSS through the pixel circuit PXC. The light emitting element EL generates light having a luminance corresponding to a driving current IDLED when the driving current IDLED is supplied from a first transistor (e.g., a driving transistor) T1.

The first power source ELVDD and the second power source ELVSS have a potential difference (e.g., a power difference or a voltage difference) that enables the light emitting element EL to emit light. For example, the first power source ELVDD may be a high potential pixel power source, and the second power source ELVSS may be a low potential pixel power source having a potential (e.g., a power level or a voltage level) that is less than that of the first power source ELVDD by a threshold voltage or more of the light emitting element EL.

The pixel circuit PXC includes a driving transistor, at least one switching transistor, and a storage capacitor Cst. For example, the pixel circuit PXC may include the first transistor T1 as the driving transistor, second to seventh transistors T2 to T7 as the switching transistors, and the storage capacitor Cst. At least one switching transistor of the switching transistors, for example, the second transistor T2 and the third transistor T3, is connected between the data line Dj and a first node N1, and includes a gate electrode connected to the scan line Si. The second transistor T2 and the third transistor T3 may transfer a voltage of a data signal to the first node N1. For example, the second transistor T2 and the third transistor T3 are turned on (e.g., concurrently or simultaneously turned on) by a scan signal having a gate-on voltage to transfer a voltage corresponding to a voltage difference between the voltage of the data signal and a threshold voltage of the first transistor T1 to the first node N1.

The first transistor T1 is connected between the first power source ELVDD and the second power source ELVSS so as to be positioned on a current path of the driving current IDLED and controls the driving current IDLED. For example, the first transistor T1 may be connected between the first power source ELVDD and the light emitting element EL. For example, a first electrode (e.g., a source electrode) of the first transistor T1 may be connected to the first power source ELVDD through the fifth transistor T5, and a second electrode (e.g., a drain electrode) of the first transistor T1 may be connected to the light emitting element EL through the sixth transistor T6.

According to an embodiment, the first transistor T1 may be a transistor having a dual gate structure. For example, the first transistor T1 may include a first gate electrode GE1 connected to the first node N1, and a second gate electrode GE2 connected to the bias control line Bi.

In an embodiment of the invention, the first gate electrode GE1 of the first transistor T1 may be disposed to be closer to a channel region than the second gate electrode GE2, and may be used to express each grayscale by controlling a voltage of the first node N1 that is applied to the first gate electrode GE1. In this case, the first transistor T1 controls the driving current IDLED that flows through the light emitting element EL in correspondence with a first voltage, for example, the voltage of the first node N1. For example, during the light emission period of a frame (e.g., of each frame), the first transistor T1 may control the driving current $I_{OLED}$ that flows from the first power source ELVDD to the second power source ELVSS through the light emitting element EL in correspondence with the voltage of the first node N1.

In addition, a control signal having a suitable voltage (e.g., a predetermined voltage) is applied to the second gate electrode GE2 of the first transistor T1 through the bias control line Bi. The voltage of the control signal may affect the threshold voltage of the first transistor T1. For example, when the first transistor T1 is a P-type transistor, the lower the voltage applied to the second gate electrode GE2, the higher the threshold voltage of the first transistor T1 may be. In other words, when the first transistor T1 is the P-type transistor, the threshold voltage of the first transistor T1 may increase as the voltage applied to the second gate electrode GE2 is decreased. On the other hand, the higher the voltage applied to the second gate electrode GE2, the lower the threshold voltage of the first transistor T1 may be. In other words, when the first transistor T1 is the P-type transistor, the threshold voltage of the first transistor T1 may decrease as the voltage applied to the second gate electrode GE2 is increased. Therefore, a characteristic of the first transistor T1 may be controlled by controlling the voltage of the control signal supplied from the bias control line Bi.

The second transistor T2 is connected between the data line Dj and the first electrode of the first transistor T1. In addition, a gate electrode of the second transistor T2 is connected to the scan line Si.

The second transistor T2 is turned on when a scan signal having a gate-on voltage is supplied from the scan line Si to connect the data line Dj to the first electrode of the first transistor T1. Therefore, when the second transistor T2 is turned on, a data signal from the data line Dj is transferred to the first electrode of the first transistor T1.

During a period in which the second transistor T2 is turned on by the scan signal, the third transistor T3 may also be turned on by the scan signal, and the first transistor T1 may be turned on in a form of a diode connection by the third transistor T3. In other words, the third transistor T3 may be turned on to diode-connect the first transistor T1. Therefore, the data signal from the data line Dj may be transferred to the first node N1 through the second transistor T2, the first transistor T1, and the third transistor T3. At this time, a voltage corresponding to the data signal and the threshold voltage of the first transistor T1 is transferred to the first node N1, and the voltage transferred to the first node N1 may be stored in the storage capacitor Cst.

The third transistor T3 is connected between the second electrode of the first transistor T1 and the first node N1. In addition, a gate electrode of the third transistor T3 is connected to the scan line Si. The third transistor T3 is turned on when the scan signal having the gate-on voltage is supplied to the scan line Si to connect the second electrode of the first transistor T1 to the first node N1. Therefore, when the third transistor T3 is turned on, the first transistor T1 is connected in a form of a diode (e.g., diode-connected).

In an embodiment, the third transistor T3 may include a plurality of transistors that are connected in series with each other to reduce a leakage current Ioff from flowing when the third transistor T3 is in an off state. For example, the third transistor T3 may include a third-first transistor (e.g., a (3_1)-th transistor) T3_1 and a third-second transistor (e.g., a (3_2)-th transistor) T3_2 that are connected in series with each other between the first node N1 and the second electrode of the first transistor T1. Gate electrodes of the (3_1)-th transistor T3_1 and the (3_2)-th transistor T3_2 may be commonly connected to the scan line Si. Therefore, the (3_1)-th transistor T3_1 and the (3_2)-th transistor T3_2 may be turned on or turned off concurrently (e.g., simultaneously or at the same or substantially the same time) in correspondence with the scan signal.

The fourth transistor T4 is connected between the first node N1 and an initialization power source Vint. In addition, a gate electrode of the fourth transistor T4 is connected to the (i−1)-th scan line Si−1. According to an embodiment, the (i−1)-th scan line Si−1 may be a scan line for supplying a data signal by selecting the pixels PXL of an (i−1)-th horizontal line, and may also be used as an initialization control line for initializing the pixels PXL of an i-th horizontal line. In other words, the (i−1)-th scan line may be the scan line of a previous pixel row (e.g., an adjacent previous pixel row), and may be used as the initialization control line of a current pixel row (e.g., the i-th pixel row). However, the invention is not limited thereto. For example, in another embodiment, the gate electrode of the fourth transistor T4 may be connected to another scan line (for example, an (i−2)-th scan line Si−2) from among previous scan lines for selecting the pixels PXL of previous horizontal lines, or another control line that is formed separately from the scan lines S1 to Sn of the pixels PXL. In this case, the fourth transistor T4 may be driven by a signal supplied from the other scan line or the separate control line.

The fourth transistor T4 is turned on when a scan signal having a gate-on voltage (hereinafter, referred to as a "previous scan signal") is supplied to the (i−1)-th scan line Si−1. When the fourth transistor T4 is turned on, a voltage of the initialization power source Vint is transferred to the first node N1, and thus, a voltage of the first node N1 is initialized to the voltage of the initialization power source Vint. In other words, the fourth transistor T4 may be turned on by the previous scan signal to initialize the voltage of the first node N1 to that of the initialization power source Vint prior to the second transistor T2 being turned on by a current scan signal (e.g., an i-th scan signal) to transfer the data signal from the data line Dj.

The voltage of the initialization power source Vint may have (e.g., may be set to) a voltage (e.g., a voltage level) that is less than or equal to the voltage (e.g., the voltage level) of the data signal. For example, the voltage of the initialization power source Vint may have (e.g., may be set to) a voltage that is less than or equal to a lowest voltage of the data signal. When the voltage of the first node N1 is initialized to the voltage of the initialization power source Vint prior to transferring the data signal of a current frame to the pixel (e.g., to each pixel) PXL, the first transistor T1 is diode-connected in a forward direction during a scan period of each horizontal line (e.g., a period in which the scan signal is supplied to each scan line Si) regardless of a data signal of a previous frame. Therefore, the data signal of the current frame may be transferred (e.g., stably transferred) to the first node N1 regardless of the data signal of the previous frame.

In an embodiment, the fourth transistor T4 may include a plurality of transistors that are connected in series with each other to reduce a leakage current. For example, the fourth transistor T4 may include a fourth-first transistor (e.g., a (4_1)-th transistor) T4_1 and a fourth-second transistor (e.g., a (4_2)-th transistor) T4_2 that are connected in series with each other between the first node N1 and the initialization power source Vint. Gate electrodes of the (4_1)-th transistor T4_1 and the (4_2)-th transistor T4_2 may be connected to (e.g., commonly connected to) the (i−1)-th scan line Si−1. Therefore, the (4_1)-th transistor T4_1 and the (4_2)-th transistor T4_2 may be turned on or turned off concurrently (e.g., simultaneously or at the same or substantially the same time) in correspondence with the previous scan signal.

When each of the third transistor T3 and the fourth transistor T4 is configured as a multi-transistor having at least a dual structure, the leakage current of each of the third transistor T3 and the fourth transistor T4 may be reduced. Therefore, the leakage current through each of the third transistor T3 and the fourth transistor T4 when in an off state during the light emission period of each frame may be reduced, and/or a voltage variation of the first node N1 may be reduced.

Although FIG. 2 illustrates an embodiment in which each of the third and fourth transistors T3 and T4 is configured as a multi-transistor (e.g., a transistor having the dual structure), the invention is not limited thereto. For example, in another embodiment, only one transistor (e.g., the third transistor T3) from among the third transistor T3 and the fourth transistor T4 may be formed as a multi-transistor, and the other transistor (e.g., the fourth transistor T4) from among the third transistor T3 and the fourth transistor T4 may be formed as a single transistor. Further, in another embodiment, a switching transistor other than the third transistor T3 and the fourth transistor T4, for example, at least one transistor from among the second transistor T2 and the fifth to seventh transistors T5 to T7 (e.g., the second transistor T2), may be formed of a multi-transistor including a plurality of transistors that are connected in series with each other.

The fifth transistor T5 is connected between the first power source ELVDD and the first transistor T1. In addition, a gate electrode of the fifth transistor T5 is connected to the light emission control line Ei. The fifth transistor T5 is turned off when the light emission control signal having a gate-off voltage is supplied to the light emission control line Ei, and is turned on in other cases. In other words, the fifth transistor T5 is turned off when the light emission control signal is supplied, and the fifth transistor T5 is turned on when the light emission control signal is not supplied.

The sixth transistor T6 is connected between the first transistor T1 and the light emitting element EL. A gate electrode of the sixth transistor T6 is connected to the light emission control line Ei. The sixth transistor T6 is turned off when the light emission control signal having the gate-off voltage is supplied to the light emission control line Ei, and is turned on in other cases. In other words, the sixth transistor T6 is turned off when the light emission control signal is supplied, and the sixth transistor T6 is turned on when the light emission control signal is not supplied.

In other words, the fifth and sixth transistors T5 and T6 may be turned on or turned off concurrently (e.g., simultaneously or at the same or substantially the same time) by the light emission control signal to control the light emission period of the pixels PXL. When the fifth and sixth transistors T5 and T6 are turned on, a current path through which the driving current IDLED flows is formed in the pixel PXL. Therefore, the pixel PXL may emit light having a luminance corresponding to the voltage of the first node N1. On the other hand, when the fifth and sixth transistors T5 and T6 are turned off, the current path may be blocked, and the pixel PXL may not emit light.

According to an embodiment, the light emission control signal may be supplied as having the gate-off voltage to turn off each of the fifth and sixth transistors T5 and T6 during an initialization period and a data programming period (e.g., a scan period) of the pixel PXL. For example, the light emission control signal having the gate-off voltage may be supplied to overlap with the scan signal having the gate-on voltage, the first control signal, and the second control signal. In addition, after voltages of the scan signal, the first control signal, and the second control signal are changed to the gate-off voltage, the light emission control signal may be changed to have the gate-on voltage. Therefore, the data signal may be stored (e.g., stably stored) in the pixel PXL prior to the light emission period of a frame (e.g., of each frame).

The seventh transistor T7 is connected between the initialization power source Vint and one electrode (e.g., an anode electrode) of the light emitting element EL. In addition, a gate electrode of the seventh transistor T7 is connected to the (i+1)-th scan line Si+1. According to an embodiment, the (i+1)-th scan line Si+1 is a scan line for supplying a data signal by selecting the pixels PXL of an (i+1)-th horizontal line, and may also be used as a bypass control line for initializing an electric charge that is charged in an organic capacitor (e.g., a parasitic capacitor generated due to a structure of the light emitting element EL) formed in the light emitting element EL of the pixels PXL positioned at the i-th horizontal line. In other words, the (i+1)-th scan line may be the scan line of a next pixel row (e.g., an adjacent next pixel row), and may be used as the bypass control line of a current pixel row (e.g., the i-th pixel row). However, the invention is not limited thereto. For example, in another embodiment, the gate electrode of the seventh transistor T7 may be connected to another scan line (e.g., an (i+2)-th scan line Si+2) from among next scan lines for selecting the pixels PXL of next horizontal lines, or another control line that is formed separately from the scan lines S1 to Sn of the pixels PXL. In this case, the seventh transistor T7 may be driven by a signal supplied from the other scan line or the separate control line.

The seventh transistor T7 is turned on when a scan signal having a gate-on voltage (hereinafter, referred to as a "next scan signal") is supplied to the (i+1)-th scan line Si+1 prior to the light emission period (e.g., each light emission period) to transfer a voltage of the initialization power source Vint to the one electrode of the light emitting element EL. Therefore, the pixel PXL may indicate a more uniform luminance characteristic with respect to each data signal.

The storage capacitor Cst is connected between the first power source ELVDD and the first node N1. The storage capacitor Cst charges a voltage corresponding to the data signal and the threshold voltage of the first transistor Ti.

As described above, each pixel PXL may include a plurality of transistors including the driving transistor (the first transistor T1) and at least one switching transistor (e.g., at least one of the second to seventh transistors T2 to T7). In an embodiment, each of the plurality of transistors may be formed of transistors having a similar structure, size, and/or type. In another embodiment, at least one of the plurality of transistors may be formed of a transistor having a structure, a size, and/or a type that is different from one or more of the other transistors. For example, the first transistor T1 may be formed as a transistor having a dual gate structure, and each of the second to seventh transistors T2 to T7 may be formed as a transistor having a single gate structure.

However, the present disclosure is not limited thereto, and a structure of the pixel circuit PXC may be variously modified according to an embodiment. For example, the pixel PXL may include the pixel circuit PXC that has various suitable structures and/or driving methods as would be known to those skilled in the art.

In addition, although each transistor is illustrated as a P-type transistor in the embodiment of FIG. 2, the invention is not limited thereto. For example, at least one of the first to seventh transistors T1 to T7 may be an N-type transistor. In this case, a gate-on voltage for turning on the N-type transistor may be a high voltage (e.g. a high voltage level).

In addition, the voltage of the data signal may be determined according to (e.g., depending on or based on) a type of the first transistor T1. For example, when the first transistor T1 is a P-type transistor, as a grayscale (e.g., a grayscale level) to be expressed is higher, a voltage of the data signal supplied to each pixel PXL may be decreased. In other words, when the first transistor T1 is a P-type transistor, the voltage of the data signal may be decreased to express a higher grayscale (e.g., a higher gray level). On the other hand, when the first transistor T1 is an N-type transistor, as a grayscale (e.g., a grayscale level) to be expressed is higher, the voltage of the data signal supplied to each pixel PXL may be increased. In other words, when the first transistor T1 is an N-type transistor, the voltage of the data signal may be increased to express a higher grayscale (e.g., a higher gray level).

Accordingly, the types of transistors that are included in the pixel PXL, and/or voltage levels of various control signals for controlling the transistors may be variously modified according to an embodiment.

The pixel PXL as described above may reduce the leakage current by configuring one or more of the third and fourth transistors T3 and T4 as the multi-transistor. However, it may be difficult to completely block the leakage current of the pixel PXL due to a characteristic of a transistor. In particular, when the pixel PXL is driven at a low frequency, a voltage variation of the first node N1 may be intensified according to the leakage current as the respective light emission periods increase (e.g., become longer).

For example, during the light emission period of a frame (e.g., each frame), a leakage current Ioff may occur in the third transistor T3 or the like that is in (e.g., set to) an off state, and the voltage of the first node N1 may vary (e.g., change) due to the leakage current Ioff. For example, as the voltage of the first node N1 increases (e.g., gradually increases) due to the leakage current Ioff, the driving current $I_{OLED}$ generated by the first transistor T1 may decrease (e.g., gradually decrease). Therefore, the luminance of the pixel PXL may be reduced as time passes (e.g., as time goes by).

For example, during low frequency driving, each light emission period may be increased (e.g., becomes longer). Therefore, the luminance reduction of the pixel PXL may be intensified.

Accordingly, in an embodiment of the invention, a voltage of the bias control line Bi is changed stepwise to compensate for a voltage increase of the first node N1 due to the leakage current Ioff with respect to the frequency of the first range (e.g., the frequency that is less than the reference frequency) where flicker may occur due to the luminance reduction of the pixel PXL. A more detailed description thereof will be described below.

Figure 3:
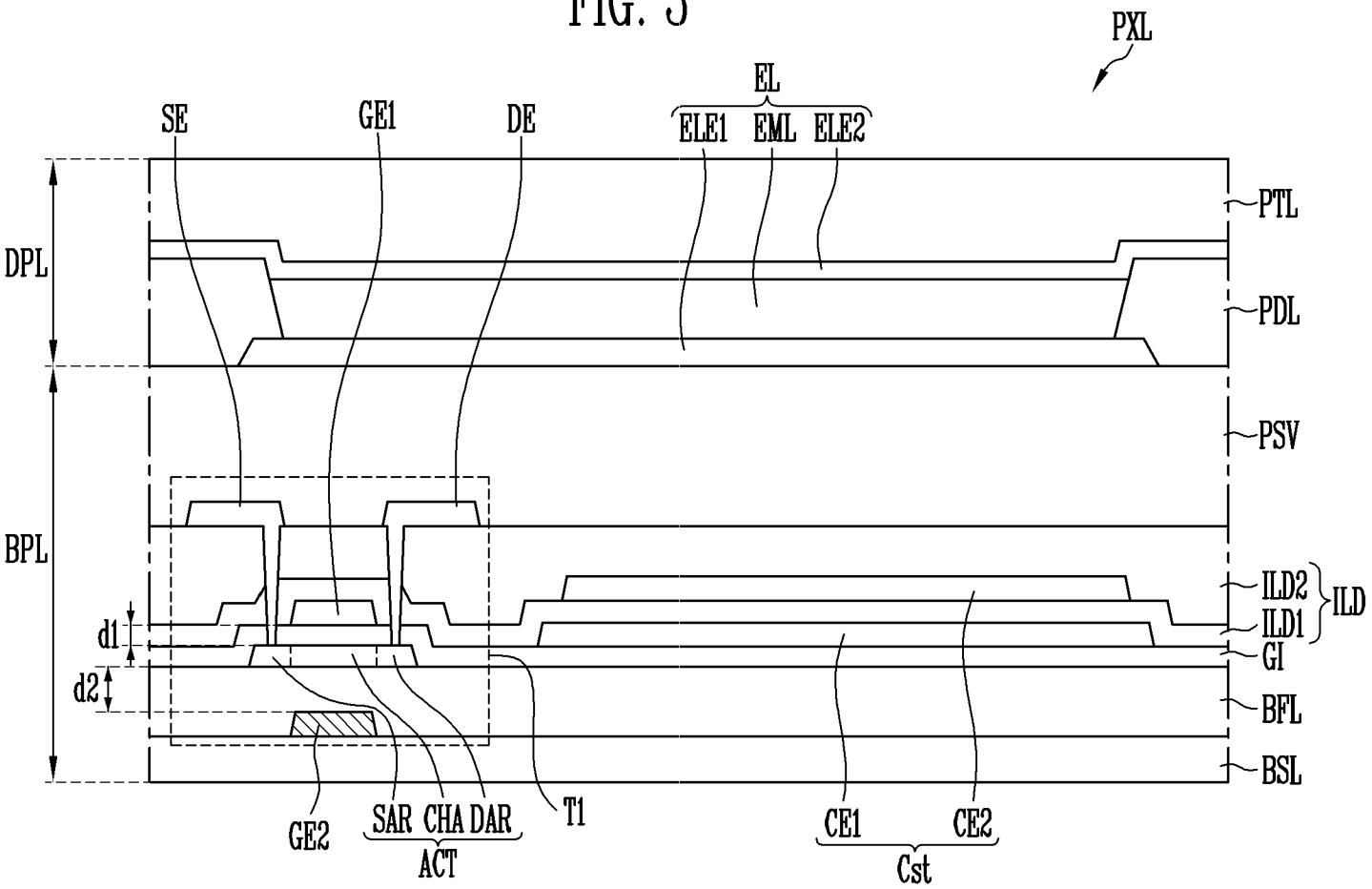
FIG. 3 is a cross-sectional view illustrating the pixel according to an embodiment of the invention.

FIG. 3 is a cross-sectional view illustrating a pixel PXL according to an embodiment of the invention. For example, FIG. 3 is a diagram illustrating a cross-sectional view of one region of the pixel PXL illustrated in FIGS. 1 and 2 corresponding to the first transistor T1 and the storage capacitor Cst from among circuit elements included in (e.g., configuring) the pixel circuit PXC of the pixel PXL. While FIG. 3 illustrates that the first transistor T1 and the storage capacitor Cst are separated from (e.g., disconnected from or not connected to) each other, the first transistor T1 and the storage capacitor Cst may be connected to each other at (e.g., in or on) another region. For example, a first gate electrode GE1 of the first transistor T1 and a first electrode CE1 of the storage capacitor Cst may be connected (e.g., integrally connected or non-integrally connected) to each other, and may be connected (e.g., commonly connected) to the first node N1 (e.g., see FIG. 2). In other words, the first gate electrode GE1 of the first transistor T1 and the first electrode CE1 of the storage capacitor Cst may be integrally formed (e.g., unitarily formed) with each other, or may be separately formed from each other and then connected (e.g., directly connected or connected through one or more intervening elements or layers) to each other.

In an embodiment, the transistors included in each pixel circuit PXC, for example, the first to seventh transistors T1 to T7, may have structures that are the same or substantially the same as (e.g., or similar to) each other, but the present invention is not limited thereto. For example, in an embodiment, the transistors of the pixel circuit PXC may have the same or substantially the same (e.g., or similar) cross-sectional structures as each other. In another embodiment, some of the transistors included in the pixel circuit PXC may have a cross-sectional structure that is different from that of at least one of the other transistors. For example, the first transistor T1 may be formed of a transistor having a dual gate structure including a first gate electrode GE1, and a second gate electrode GE2 that is disposed to overlap with an active layer pattern ACT between a base layer BSL and a buffer layer BFL, and the other remaining transistors may be formed of one or more transistors having a single gate structure. In addition, a structure and/or a position of the transistors (e.g., the first transistor T1) and the storage capacitor Cst is not limited to the embodiment shown in FIG. 3, and may be variously modified according to another embodiment.

Referring to FIGS. 1 to 3, the pixel PXL according to an embodiment of the invention and a display panel having the same (e.g., at least a panel including the display area 10) may include circuit elements of the pixel PXL, a backplane layer BPL (also referred to as a "circuit element layer" or a "circuit layer") on which wires connected to the pixel PXL are disposed, and a display element layer DPL disposed on the backplane layer BPL. The light emitting element EL of the pixel (e.g., of each pixel) PXL is disposed on the display element layer DPL.

The backplane layer BPL may include at least one circuit element that is connected to the light emitting element EL of the pixel PXL. For example, the backplane layer BPL may include the corresponding plurality of transistors and the storage capacitor Cst for each pixel area and included in the pixel circuit PXC of each of the pixels PXL. In addition, the backplane layer BPL may further include signal lines and power lines that are connected to each pixel circuit PXC and/or the light emitting element EL of each pixel circuit PXC. For example, the backplane layer BPL may include a first power line, a second power line, and an initialization power line for supplying the first power source ELVDD, the second power source ELVSS, and the initialization power source Vint, respectively, to each of the pixels PXL, and may further include each of the scan lines S1 to Sn, the light emission control lines E1 to En, the bias control lines B1 to Bn, the data lines D1 to Dm, and/or the like that are connected to the pixels PXL.

In addition, the backplane layer BPL may include the base layer BSL, which is a base (e.g., a substrate) of the display panel, and a plurality of insulating layers disposed on the base layer BSL. For example, the backplane layer BPL may include the buffer layer BFL, a gate insulating layer GI, an interlayer insulating layer ILD, and a passivation layer PSV that are stacked (e.g., sequentially stacked) on a surface (e.g., one surface) of the base layer BSL.

The base layer BSL may include (or may be) a rigid substrate or film or a flexible substrate or film, and a material or a physical property of the base layer BSL is not limited thereto. For example, the base layer BSL may be a rigid substrate formed of glass or tempered glass, a flexible substrate (or a thin film) including a plastic or metal material, an insulating film including at least one layer, and/or the like, but the material and/or the physical property thereof is not limited thereto.

In addition, the base layer BSL may be transparent, but is not limited thereto. For example, the base layer BSL may be a transparent base member, a translucent base member, an opaque base member, a reflective base member, and/or the like.

One area of the base layer BSL may be defined as the display area 10, and thus, the pixels PXL may be disposed at the one area, and another area (e.g., a remaining area) of the base layer BSL may be defined as a non-display area. For example, the base layer BSL may include the display area 10 including a plurality of pixel areas at (e.g., in or on) which the pixels PXL are respectively formed, and the non-display area that is positioned outside the display area 10. At (e.g., in or on) the non-display area, various wires and/or internal circuits (e.g., the scan driver 21, the light emission control driver 22, and/or the control line driver 23) that are connected to the pixels PXL of the display area 10 may be disposed.

The buffer layer BFL may prevent or substantially prevent diffusion of an impurity in a circuit element (e.g., in each circuit element). The buffer layer BFL may include a single layer, or may include multiple layers of at least two or more layers. When the buffer layer BFL is provided as the multiple layers, each layer may be formed of the same or substantially the same material or at least one layer from among the multiple layers may be formed of a different material from at least one other layer from among the multiple layers.

The first transistor T1 includes an active layer pattern ACT, a first gate electrode GE1, a second gate electrode GE2, a source electrode SE, and a drain electrode DE. According to an embodiment, the source electrode SE and the drain electrode DE may also be referred to as a first transistor electrode and a second transistor electrode, respectively. While FIG. 3 illustrates an embodiment in which the first transistor T1 includes source and drain electrodes SE and DE that are formed separately from the active layer pattern ACT, the invention is limited thereto. For example, in another embodiment of the invention, the source electrode SE and/or the drain electrode DE of the first transistor T1 and/or of at least one of the other transistors may be integrated (e.g., integrally formed or unitarily formed) with the respective active layer pattern ACT.

The active layer pattern ACT may be disposed on the buffer layer BFL. For example, the active layer pattern ACT may be disposed on one surface of the base layer BSL on which the buffer layer BFL is formed. The active layer pattern ACT may include a source region SAR that is connected to the source electrode SE, a drain region DAR that is connected to the drain electrode DE, and a channel region CHA that is positioned between the source and drain regions SAR and DAR. According to an embodiment, the source region SAR and the drain region DAR may also be referred to as a first conductive region and a second conductive region, respectively.

According to an embodiment, the active layer pattern ACT may be a semiconductor pattern including (e.g., formed of), for example, polysilicon, amorphous silicon, an oxide semiconductor, and/or the like. Each of the source and drain regions SAR and DAR of the active layer pattern ACT may be a semiconductor pattern that is doped with an impurity. In addition, the channel region CHA of the active layer pattern ACT may be an intrinsic semiconductor, for example, a semiconductor pattern that is not doped with an impurity, unlike each of the source and drain regions SAR and DAR of the active layer pattern ACT that are doped with an impurity.

In an embodiment, the active layer patterns ACT of the transistors of each pixel circuit PXC may be formed of the same or substantially the same (e.g., or similar) material. For example, the active layer patterns ACT of the transistors may be formed of the same or substantially the same material including polysilicon, amorphous silicon, and/or an oxide semiconductor. In another embodiment, at least one of the transistors may include an active layer pattern ACT that is formed of a different material from that of at least one of the other remaining transistors. For example, the active layer pattern ACT of at least one of the transistors may be formed of polysilicon or amorphous silicon, and the active layer pattern ACT of at least one of the other remaining transistors may be formed of an oxide semiconductor.

The first gate electrode GE1 and the second gate electrode GE2 may each overlap with the active layer pattern ACT of the first transistor T1, for example, the channel region CHA of the active layer pattern ACT. The first gate electrode GE1 and the second gate electrode GE2 may be disposed on different layers from each other with the channel region CHA interposed therebetween. For example, the first gate electrode GE1 may be positioned above the channel region CHA, and the second gate electrode GE2 may be positioned below the channel region CHA. For example, the first gate electrode GE1 may be disposed on the gate insulating layer GI to overlap with the channel region CHA, and the second gate electrode GE2 may be disposed between the base layer BSL and the buffer layer BFL to overlap with the channel region CHA. In an embodiment, the second gate electrode GE2 may be formed of a light blocking pattern including a conductive material, but the invention is not limited thereto.

The first gate electrode GE1 and the second gate electrode GE2 may be electrically isolated (e.g., disconnected or not connected) from each other, and may each be connected to different nodes, circuit elements, and/or wires from each other. For example, the first gate electrode GE1 may be connected to the first node N1, and the second gate electrode GE2 may be connected to the bias control line Bi.

The gate insulating layer GI may be disposed on the active layer pattern ACT. For example, the gate insulating layer GI may be interposed between the active layer pattern ACT and the first gate electrode GE1. The gate insulating layer GI may include a single layer or multiple layers, and may include at least one inorganic insulating material and/or an organic insulating material. For example, the gate insulating layer GI may include various suitable kinds of organic/inorganic insulating materials as would be known to those skilled in the art, including silicon nitride (SiNx), silicon oxide (SiOx), a combination thereof, and/or the like. However, the configuration material of the gate insulating layer GI is not limited thereto.

According to an embodiment, a thickness of the gate insulating layer GI may be less than a thickness of the buffer layer BFL. Therefore, a distance d1 between the first gate electrode GE1 and the channel region CHA of the first transistor T1 may be less than a distance d2 between the second gate electrode GE2 and the channel region CHA of the first transistor T1. In this case, a magnitude of the driving current IDLED generated by the first transistor T1 may be mainly determined by a first gate voltage that is applied to the first gate electrode GE1. However, the threshold voltage of the first transistor T1 may be changed according to a voltage of a control signal that is applied to the second gate electrode GE2, and the voltage of the control signal may be a "back-bias voltage".

The interlayer insulating layer ILD may be disposed on the first gate electrode GE1. For example, the interlayer insulating layer ILD may be interposed between the first gate electrode GE1 and the source and drain electrodes SE and DE. The interlayer insulating layer ILD may include (e.g., or be configured as) a single layer or multiple layers. For example, the interlayer insulating layer ILD may include multiple layers including a first interlayer insulating layer ILD1 and a second interlayer insulating layer ILD2.

In addition, the interlayer insulating layer ILD may include at least one inorganic insulating material and/or an organic insulating material. For example, the interlayer insulating layer ILD may include various kinds of organic/inorganic insulating materials as would be known to those skilled in the art, but a configuration material of the interlayer insulating layer ILD is not limited thereto.

The source and drain electrodes SE and DE may be disposed on the active layer pattern ACT with at least the interlayer insulating layer ILD interposed therebetween. For example, the source and drain electrodes SE and DE may be disposed on different end portions of the active layer pattern ACT with the gate insulating layer GI and the interlayer insulating layer ILD interposed therebetween. The first and second transistor electrodes SE and DE may be electrically connected to the active layer pattern ACT. For example, the source electrode SE may be connected to the source region SAR of the active layer pattern ACT through a contact hole that extends (e.g., passes) through each of the gate insulating layer GI and the interlayer insulating layer ILD, and the drain electrode DE may be connected to the drain region DAR of the active layer pattern ACT through another contact hole that extends (e.g., passes) through each of the gate insulating layer GI and the interlayer insulating layer ILD.

The storage capacitor Cst may include a first electrode CE1 (also referred to as a "lower electrode" or a "first storage electrode") and a second electrode CE2 (also referred to as an "upper electrode" or a "second storage electrode") that are disposed on the same layer as or on a different layer from that of any one electrode of the first transistor T1. For example, the first electrode CE1 of the storage capacitor Cst may be disposed on the gate insulating layer GI, which is the same layer as that of the first gate electrode GE1, and the second electrode CE2 of the storage capacitor Cst may be disposed on a different layer from those of the electrodes of the first transistor T1. For example, the second electrode CE2 of the storage capacitor Cst may be disposed between the first interlayer insulating layer ILD1 and the second interlayer insulating layer ILD2.

However, structures and/or positions of various circuit elements, wires, and/or insulating layers that are formed at (e.g., in or on) the backplane layer BPL may be variously modified according to other embodiments.

The passivation layer PSV may be disposed on the circuit elements and the wires. The passivation layer PSV may include a single layer or multiple layers. When the passivation layer PSV is provided in multiple layers, each layer may be formed of the same or substantially the same material or formed from one or more different materials. For example, the passivation layer PSV may include multiple layers including a first passivation layer and a second passivation layer. In this case, the first passivation layer may include at least one inorganic insulating layer, and the second passivation layer may include at least one organic insulating layer. When the passivation layer PSV includes an organic insulating layer, a surface of the backplane layer BPL may be flat or substantially flat.

The display element layer DPL includes the light emitting element EL. In addition, the display element layer DPL may further include a bank structure for defining a light emission area (e.g., a light emission area of each pixel PXL) at (e.g., in or on) which the light emitting element (e.g., each light emitting element) EL is disposed, for example, a pixel defining film PDL, and a protective layer PTL for protecting the light emitting element EL.

The light emitting element EL includes a first electrode ELE1, a light emitting layer EML, and a second electrode ELE2 that are stacked (e.g., sequentially stacked) on the passivation layer PSV. According to an embodiment, one of the first and second electrodes ELE1 and ELE2 of the light emitting element EL may be an anode electrode, and the other of the first and second electrodes ELE1 and ELE2 may be a cathode electrode. For example, when the first electrode ELE1 is the anode electrode, the second electrode ELE2 may be the cathode electrode. On the other hand, when the first electrode ELE1 is the cathode electrode, the second electrode ELE2 may be the anode electrode.

The first electrode ELE1 of the light emitting element EL may be disposed on the passivation layer PSV, and may be connected to at least one circuit element of the pixel circuit PXC through a contact hole. For example, the first electrode ELE1 may be connected to an electrode (e.g., one electrode) of each of the sixth and seventh transistors T6 and T7 through a contact hole or a via hole that extends (e.g., passes) through the passivation layer PSV.

At (e.g., in or on) each pixel area in which the first electrode ELE1 is formed, the pixel defining film PDL may be formed to partition (e.g., define) the light emission area of the corresponding pixel PXL. The pixel defining film PDL may be disposed between the light emission areas of the pixels PXL, and may have an opening portion that exposes the first electrode ELE1 at (e.g., in or on) the light emission area of each pixel PXL. For example, the pixel defining film PDL may protrude upward from a surface (e.g., one surface) of the base layer BSL on which the first electrode ELE1 and the like are formed, and may extend along an outer circumference (e.g., along a periphery) of the light emission area of each pixel PXL.

The light emitting layer EML may be formed at (e.g., in or on) each light emission area that is surrounded by the pixel defining film PDL. For example, the light emitting layer EML may be disposed on an exposed surface of the first electrode ELE1. According to an embodiment, the light emitting layer EML may have a multi-layer structure (e.g., a multi-layer thin film structure) including at least a light generation layer. For example, the light emitting layer EML may include a light generation layer for emitting light having a suitable color (e.g., a predetermined color), a first common layer disposed between the light generation layer and the first electrode ELE1, and a second common layer disposed between the light generation layer and the second electrode ELE2. According to an embodiment, the first common layer may include at least one of a hole injection layer and a hole transport layer. According to an embodiment, the second common layer may include at least one of a hole blocking layer, an electron transport layer, and an electron injection layer. According to an embodiment, the light generation layer may be individually patterned in correspondence with each light emission area. In addition, the first common layer and the second common layer may be formed (e.g., entirely formed) on the display area 10 at (e.g., in or on) which the pixels PXL are disposed.

The second electrode ELE2 of the light emitting element EL may be formed on the light emitting layer EML. According to an embodiment, the second electrode ELE2 may be entirely formed on the display area 10, but the invention is not limited thereto.

The protective layer PTL may be formed on the light emitting element EL to cover the second electrode ELE2 of the light emitting element EL. According to an embodiment, the protective layer PTL may include an encapsulation layer or an encapsulation substrate that is disposed on one area (e.g., at least the display area 10) of the display panel on which the pixels PXL are disposed to seal or substantially seal the pixels PXL. For example, the protective layer PTL may include a thin film encapsulation layer. When the thin film encapsulation layer is formed to seal the display area 10, a thickness of the display panel may be reduced, and/or flexibility of the display panel may be secured while protecting the pixels PXL.

According to an embodiment, the protective layer PTL may include (or may be formed of) a single layer or multiple layers. For example, the protective layer PTL may include multiple layers including at least two inorganic layers that overlap with each other, and at least one organic layer that is interposed between the inorganic layers. However, a structure, a material, and/or the like of the protective layer PTL may be variously modified according to other embodiments.

However, the structures of the pixel PXL and the display panel including the same are not limited to the embodiment shown in FIG. 3, and may be variously modified according to other embodiments. For example, the pixel PXL and the display panel including the same may be formed to have various suitable structures as would be known to those skilled in the art.

Figure 4:
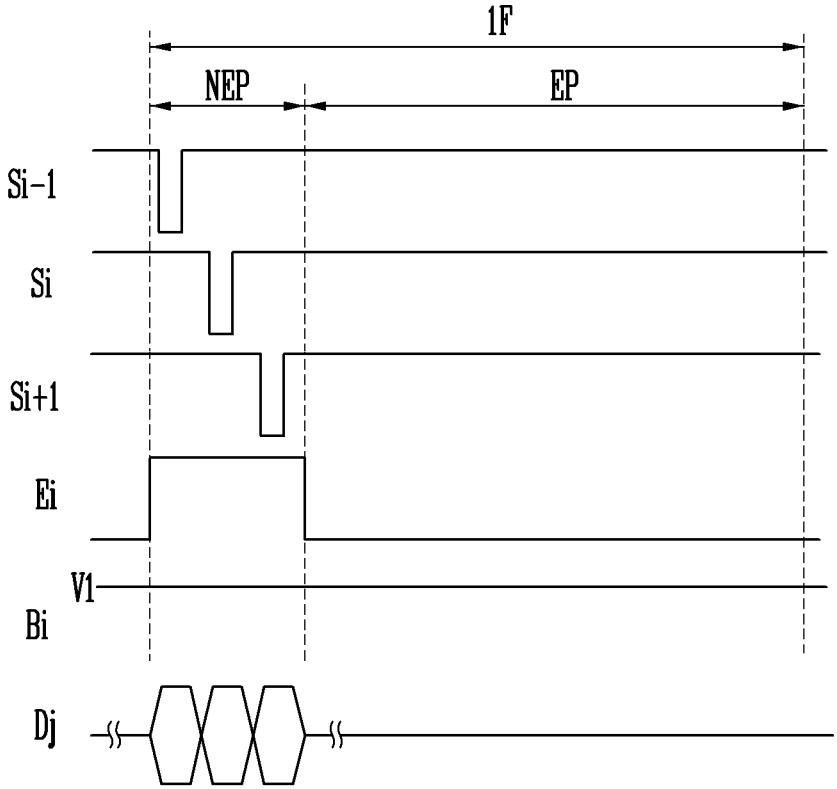
FIG. 4 is a waveform diagram illustrating signals for driving the pixel according to an embodiment of the invention.
Figure 5:
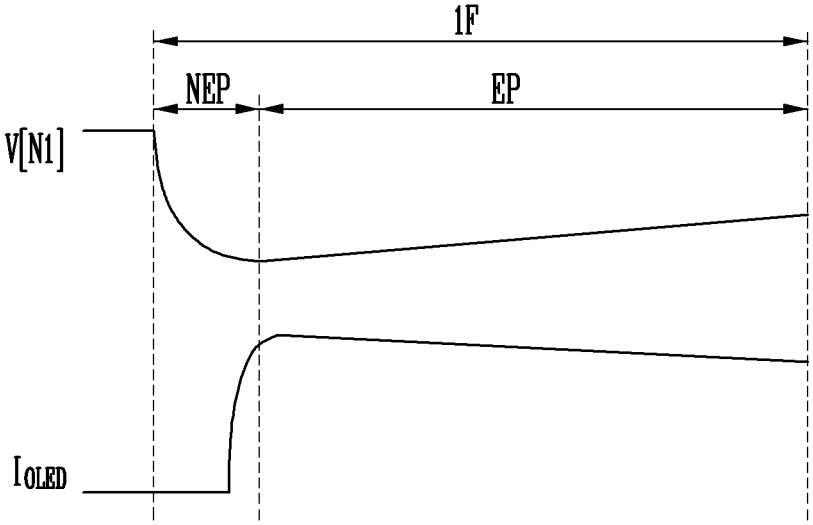
FIG. 5 is a waveform diagram illustrating a driving current of the pixel according to the signals of FIG. 4, in accordance with an embodiment of the invention.
Figure 6:
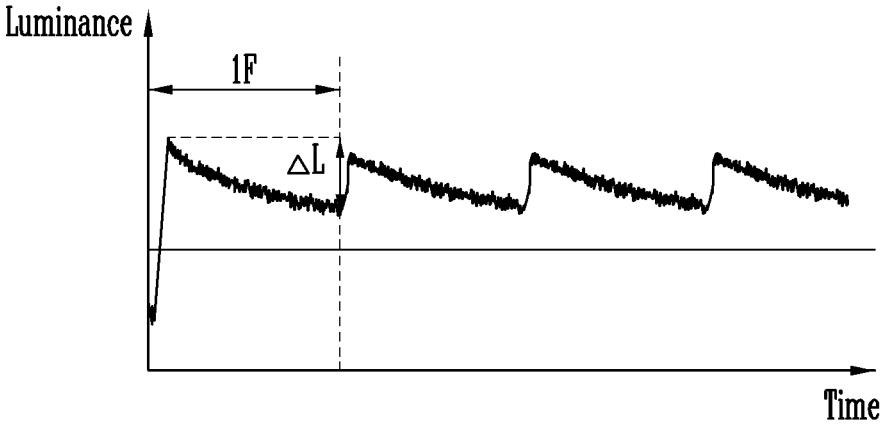
FIG. 6 is a graph illustrating a luminance change of a display panel including the pixel according to an embodiment of the invention.

FIG. 4 is a waveform diagram illustrating signals for driving the pixel PXL according to an embodiment of the invention. FIG. 5 is a waveform diagram illustrating a driving current IDLED of the pixel PXL according to the signals of FIG. 4, in accordance with an embodiment of the invention. FIG. 6 is a graph illustrating a luminance change (e.g., a luminance variation) of the display panel including the pixel PXL according to an embodiment of the invention.

For example, FIG. 4 illustrates an exemplary waveform of driving signals supplied to each signal line connected to the pixel PXL to drive the pixel PXL of FIGS. 1 to 3 with respect to the frequency of the second range that is greater than or equal to the reference frequency (e.g., 60 Hz), and FIG. 5 schematically illustrates variations (e.g., changes) in a voltage V[N1] of the first node N1 and the driving current IDLED according to the driving signals. In addition, FIG. 6 illustrates a light waveform that is measured in a panel (e.g., the display panel) after driving the panel of the display device 1 having the pixels PXL of FIGS. 1 to 3 at a suitable driving frequency (e.g., a predetermined driving frequency) such as, for example, 30 Hz.

First, referring to FIGS. 1 to 5, one frame 1F may include a non-light emission period NEP and a light emission period EP.

The non-light emission period NEP of the one frame (e.g., of each frame) 1F is a period during which a light emission control signal having a gate-off voltage is supplied to the light emission control line Ei of the pixel (e.g., of each pixel) PXL, and each scan signal may be supplied to the scan lines connected to the pixel PXL during the non-light emission period NEP. For example, in a method of driving the pixel PXL of the i-th horizontal line shown in FIG. 2, a scan signal having a gate-on voltage may be sequentially supplied to the (i−1)-th scan line Si−1, the i-th scan line Si, and the (i+1)-th scan line Si+1 during the non-light emission period NEP of the one frame (e.g., of each frame) 1F.

When the light emission control signal having the gate-off voltage is supplied to the light emission control line Ei, the fifth and sixth transistors T5 and T6 are turned off. Therefore, the current path through which the driving current $I_{OLED}$ flows is blocked (e.g., disconnected), and thus, the pixel PXL maintains or substantially maintains a non-light emission state.

When the scan signal having the gate-on voltage is supplied to the (i−1)-th scan line Si−1, the fourth transistor T4 is turned on. Therefore, the first node N1 is initialized to the voltage of the initialization power source Vint.

When the scan signal having the gate-on voltage is supplied to the i-th scan line Si, the second and third transistors T2 and T3 are turned on. In addition, the first transistor T1 is turned on in a form of a diode connection by the third transistor T3. In other words, the first transistor T1 is turned on and is diode-connected by the third transistor T3. Therefore, the data signal from the data line Dj may be transferred to the first node N1 through the second transistor T2, the first transistor T1, and the third transistor T3, sequentially. At this time, the voltage corresponding to the data signal and the threshold voltage of the first transistor T1 (e.g., a difference voltage between the voltage of the data signal and the threshold voltage of the first transistor T1) is transferred to the first node N1, and the voltage (e.g., the difference voltage) that is transferred to the first node N1 is stored in the storage capacitor Cst.

When the scan signal having the gate-on voltage is supplied to the (i+1)-th scan line Si+1, the seventh transistor T7 is turned on. Therefore, the voltage of the initialization power source Vint is transferred to the anode electrode of the light emitting element EL, and thus, charges that are charged in the parasitic capacitor of the light emitting element EL during a previous frame period are initialized.

The non-light emission period NEP ends when the voltage of the light emission control line Ei is changed to the gate-on voltage, and the light emission period EP starts after the non-light emission period NEP. During the light emission period EP of the one frame (e.g., of each frame) 1F, the voltage of the light emission control line Ei is maintained or substantially maintained at the gate-on voltage. Therefore, the fifth and sixth transistors T5 and T6 are turned on, and thus, the current path through which the driving current $I_{OLED}$ flows to the light emitting element EL is formed (e.g., electrically connected) in the pixel PXL.

However, a time point at which the driving current $I_{OLED}$ flows to the light emitting element EL may be changed according to characteristics of transistors included in (e.g., configuring or defining) the pixel circuit PXC, and/or characteristics of various driving signals. For example, in the pixel PXL according to an embodiment, the driving current $I_{OLED}$ may start to flow from an end of the non-light emission period NEP, and the driving current $I_{OLED}$ may flow in earnest during the light-emission period EP. Alternatively, in the pixel PXL according to another embodiment, the driving current $I_{OLED}$ may start to flow after the light emission period EP starts (e.g., after the non-light emission period NEP ends and the light emission period EP starts).

During the light emission period EP of the one frame (e.g., of each frame) 1F, the first transistor T1 generates the driving current $I_{OLED}$ corresponding to the voltage (e.g., the difference voltage) of the first node N1. The driving current $I_{OLED}$ flows from the first power source ELVDD to the second power source ELVSS through the light emitting element EL. Therefore, the light emitting element EL emits light having a luminance corresponding to the driving current $I_{OLED}$.

On the other hand, during the non-light emission period NEP of each frame 1F, for example, during the period in which the scan signal having the gate-on voltage is supplied to the i-th scan line Si, when a data signal corresponding to a black grayscale level is supplied to the data line Dj, the first transistor T1 does not or substantially does not generate the driving current $I_{OLED}$ (e.g., or generates the driving current $I_{OLED}$ to correspond to the black grayscale level). In this case, the pixel PXL maintains or substantially maintains the non-light emission state even during the corresponding light emission period EP of the one frame 1F to express the black grayscale.

However, when the leakage current Ioff occurs in at least one switching transistor (e.g., the third transistor T3) during the light emission period (e.g., during each light emission period) EP, the voltage V[N1] of the first node N1 may vary (e.g., be changed) due to the leakage current Ioff. For example, the driving current IDLED may decrease (e.g., gradually decrease) while the voltage V[N1] of the first node N1 increases (e.g., gradually increases) due to the leakage current Ioff during the light emission period EP. Therefore, the luminance of the pixel PXL may be reduced (e.g., gradually reduced) during the light emission period EP.

In an embodiment of the invention, the driving circuit 20 may drive the pixels PXL in the second mode with respect to the frequency of the second range that is greater than or equal to the reference frequency, and may supply the control signal having the constant voltage to the bias control line Bi of the pixel (e.g., of each pixel) PXL in correspondence with the second mode. For example, the driving circuit 20 may drive each pixel PXL in the second mode with respect to a frequency that is greater than or equal to 60 Hz (e.g., the reference frequency), and may supply (e.g., continuously supply) the control signal having a first voltage V1 to the bias control line (e.g., to each bias control line) Bi in correspondence with the second mode. In this case, the threshold voltage of the first transistor T1 may be controlled to have a constant value.

According to an embodiment, the reference frequency may be determined according to (e.g., depending on or based on) a luminance characteristic or the like of the pixels PXL and the display panel having the same. For example, when the voltage V[N1] of the first node N1 is varied (e.g., changed) due to the leakage current Ioff generated in the pixel (e.g., in each pixel) PXL, and thus, the driving current $I_{OLED}$ is reduced (e.g., gradually reduced) during the light emission period (e.g., during each light emission period) EP, a reduction amount of the driving current $I_{OLED}$ may increase as the light emission period (e.g., each light emission period) EP increases (e.g., becomes longer), and thus, the luminance reduction of the pixels PXL may be intensified.

Accordingly, in an embodiment of the invention, a suitable driving frequency (e.g., a predetermined or specific driving frequency) may be used as (e.g., set as) the reference frequency (e.g., 60 Hz) at which the light emission period (e.g., each light emission period) EP is sufficiently decreased (e.g., set to be sufficiently short) so that the luminance reduction due to the leakage current Ioff may not be recognized by the user, and the pixels PXL may be driven in the second mode at a frequency that is greater than or equal to the reference frequency. For example, in a case where flicker due to the luminance reduction may not be recognized when the pixels PXL are driven at 60 Hz, and the flicker due to the luminance reduction may be recognized when the pixels PXL are driven at a frequency less than 60 Hz, the reference frequency may be set to 60 Hz.

For example, as a result of measuring the light waveform of the display panel while driving the pixels PXL at 30 Hz using the driving signals shown in FIG. 4, a luminance reduction phenomenon may appear in the display panel as shown in FIG. 6. At this time, when a luminance variation ΔL (e.g., a luminance reduction amount) of the display panel is about 10% or more, the luminance variation may be recognized as flicker by the user.

On the other hand, when the light emission period (e.g., each light emission period) EP is sufficiently short (e.g., sufficiently decreased) according to the high frequency driving of the pixels PXL, the reduction amount of the driving current IDLED may be relatively small. For example, when measuring the light waveform of the display panel while driving the pixels PXL at 60 Hz (e.g., in the second mode), the luminance variation ΔL of the display panel may be significantly reduced, and thus, the flicker may not be observed when compared to the case where the pixels PXL are driven at 30 Hz. In this case, at the time of the high frequency driving of 60 Hz or more, unnecessary power consumption may be prevented or reduced by supplying a control signal having a suitable voltage (e.g., a suitable DC voltage) to the bias control line (e.g., to each bias control line) Bi.

In an embodiment of the invention, when (e.g., at the time) the pixels PXL are driven by the low frequency driving during which the pixels PXL are driven at the frequency that is less than the reference frequency, the variation (e.g., change) of the voltage V[N1] of the first node N1 due to the leakage current Ioff may be compensated by changing the voltage of the control signal that is supplied to the bias control line (e.g., to each bias control line) Bi stepwise. A more description thereof will be provided below.

Figure 7:
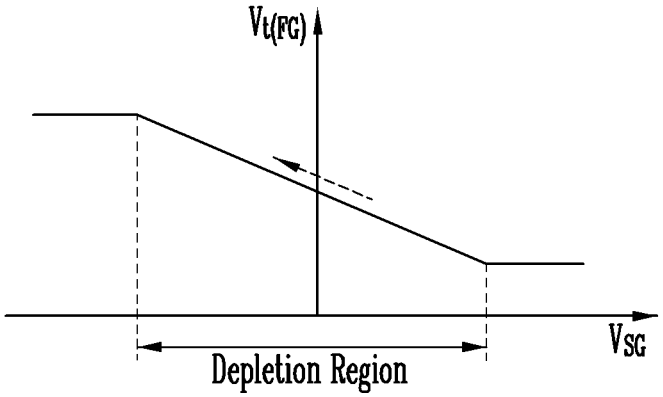
FIG. 7 is a graph illustrating a threshold voltage of a first transistor according to a second gate voltage.

FIG. 7 is a graph illustrating a threshold voltage $Vt_{(FG)}$ of the first transistor T1 according to a second gate voltage $V_{SG}$. For example, FIG. 7 is a graph illustrating the threshold voltage $Vt_{(FG)}$ of the first transistor T1 according to the second gate voltage $V_{SG}$ applied to the second gate electrode GE2 of the first transistor T1 shown in FIG. 2. The threshold voltage $Vt_{(FG)}$ of the first transistor T1 may represent a threshold voltage with respect to a first gate voltage applied to the first gate electrode GE1.

Referring to FIGS. 2 and 7, when the second gate voltage $V_{SG}$ that is applied to the second gate electrode GE2 of the first transistor T1 is changed in a depletion region range, the threshold voltage of $Vt_{(FG)}$ of the first transistor T1 may be changed. For example, when the first transistor T1 is a P-type transistor, the threshold voltage $Vt_{(FG)}$ of the first transistor T1 may increase as the second gate voltage $V_{SG}$ decreases.

Therefore, the threshold voltage $Vt_{(FG)}$ of the first transistor T1 may be controlled by controlling the voltage (e.g., the voltage level) of the control signal that is supplied to the bias control line (e.g., each bias control line) Bi. For example, when the voltage V[N1] of the first node N1 is increased due to the leakage current Ioff, the threshold voltage $Vt_{(FG)}$ of the first transistor T1 may be increased by decreasing the voltage of the control signal that is supplied to the bias control line Bi. Therefore, a uniform or substantially uniform driving current IDLED may flow through the light emitting element EL by the first transistor T1 by compensating for the increase of the voltage V[N1] of the first node N1.

Figure 8:
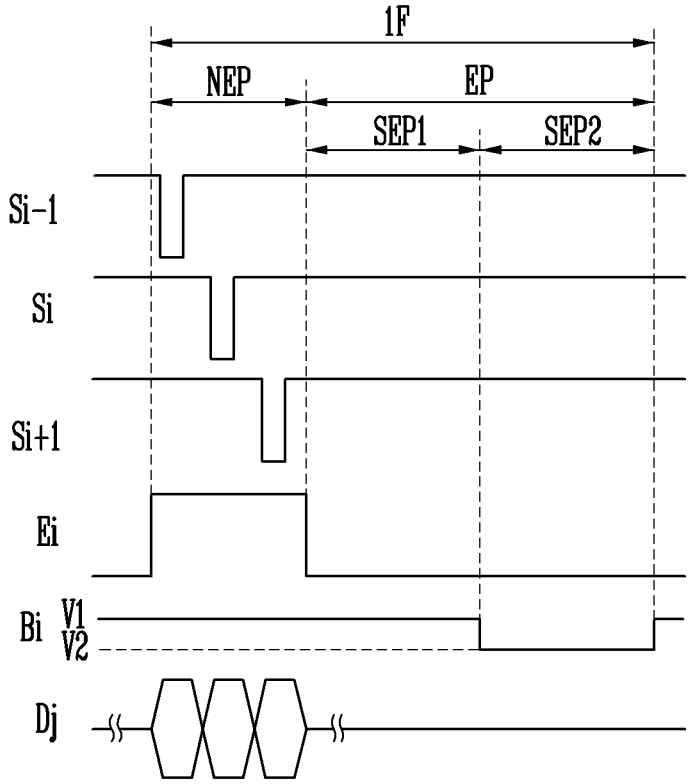
FIG. 8 is a waveform diagram illustrating signals for driving the pixel according to an embodiment of the invention.
Figure 9:
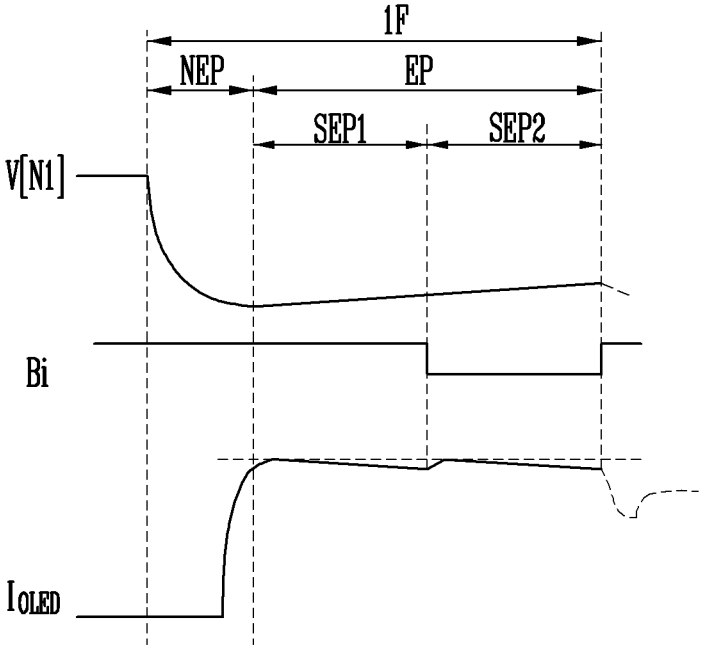
FIG. 9 is a waveform diagram illustrating a driving current of the pixel according to the signals of FIG. 8, in accordance with an embodiment of the invention.

FIG. 8 is a waveform diagram illustrating signals for driving the pixel PXL according to an embodiment of the invention. FIG. 9 is a waveform diagram illustrating a driving current IDLED of the pixel PXL according to the signals of FIG. 8, in accordance with an embodiment of the invention. For example, FIG. 8 illustrates an exemplary waveform of the driving signals supplied to each signal line connected to the pixel PXL to drive the pixel PXL of FIGS. 1 to 3 with respect to a frequency of 30 Hz, and FIG. 9 schematically illustrates changes in the voltage V[N1] of the first node N1 and the driving current IDLED according to the driving signals. In the following description with reference to an embodiment of FIGS. 8 and 9, redundant descriptions of components, configurations, operations, and/or methods that are the same or substantially the same as (e.g., or similar to) those of FIGS. 4 and 5 may not be repeated.

Referring to FIGS. 1 to 9, each light emission period EP may be divided into a plurality of sub light emission periods. In an embodiment, the sub light emission periods may be continued for the same or substantially the same time, but the invention is not limited thereto. For example, the plurality of sub light emission periods may collectively have the same or substantially the same duration as that of the original (or single) light emission period EP, but the present invention is not limited thereto. In another example, each of the plurality of sub light emission periods may have the same or substantially the same duration as that of the original (or single) light emission period EP, but the present invention is not limited thereto. In still another example, each of the sub light emission periods may have the same or substantially the same duration as each other, but the invention is not limited thereto. In yet another example, at least one of the sub light emission periods may have a duration that is different from at least another one of the sub light emission periods, but the invention is not limited thereto.

The driving circuit 20 may drive the pixels PXL in the first mode at the frequency of the first range, and may divide the light emission period EP of the pixel (e.g., of each pixel) PXL into the plurality of sub light emission periods in correspondence with the first mode. For example, when driving the pixels PXL at a suitable frequency (e.g., a predetermined driving frequency) corresponding to the frequency of the first range, the timing controller 25 may divide the light emission period EP of the pixels PXL disposed at (e.g., in or on) each horizontal line into a plurality of sub light emission periods including a first sub light emission period SEP1 and a second sub light emission period SEP2.

Hereinafter, when referring to a particular one of the sub light emission periods from among the first and second sub light emission periods SEP1 and SEP2, a corresponding sub light emission period may be referred to as the "first sub light emission period SEP1" or the "second sub light emission period SEP2" as the case may be. On the other hand, when referring to one of the first and second sub light emission periods SEP1 and SEP2 arbitrarily, or when referring to the first and second sub light emission periods SEP1 and SEP2 collectively, the first and second sub light emission periods SEP1 and SEP2 may be referred to as a "sub light emission period SEP" or "sub light emission periods SEP".

In an embodiment, the driving circuit 20 may drive the pixels PXL at a suitable frequency (e.g., 30 Hz) that is less than the reference frequency (e.g., 60 Hz). In this case, the driving circuit 20 (e.g., the timing controller 25) may divide each light emission period EP into a plurality of sub light emission periods (e.g., two sub light emission periods) SEP, for example, the first sub light emission period SEP1 and the second sub light emission period SEP2 with respect to the suitable frequency of, for example, 30 Hz.

According to an embodiment, the sub light emission periods SEP may be continued for the same or substantially the same time as each other. For example, each of the first sub light emission period SEP1 and the second sub light emission period SEP2 may have the same or substantially the same duration (e.g., be continued for a length of time that is the same or substantially the same as or similar to) that of the light emission period (e.g., each light emission period) EP when the pixels PXL are driven at 60 Hz. However, the invention is not limited thereto. For example, in another embodiment, the first sub light emission period SEP1 and the second sub light emission period SEP2 may have durations (e.g., continuance times) of different lengths from each other.

In addition, in the first mode, the driving circuit 20 may supply a control signal having a different voltage to the bias control line Bi during each sub light emission period SEP. For example, the timing controller 25 may control the control line driver 23 to change the voltage of the control signal supplied to the corresponding bias control line Bi in correspondence with the plurality of sub light emission periods SEP of the light emission period (e.g., of each light emission period) EP. Therefore, the control line driver 23 may supply the control signal having different voltages to the bias control line Bi during each sub light emission period SEP. For example, the control line driver 23 may supply a control signal having a first voltage (or a first voltage level) V1 to the bias control line Bi during the first sub light emission period SEP1, and supply a control signal having a second voltage (e.g., a second voltage level) V2 to the bias control line Bi during the second sub light emission period SEP2 subsequent to the first sub light emission period SEP1.

In an embodiment, the driving circuit 20 may increase or decrease the voltage of the control signal by a suitable voltage (e.g., a predetermined voltage or voltage level) stepwise to supply the controls signals to the respective bias control lines Bi in correspondence with the sub light emission periods SEP. For example, when the first transistor T1 is a P-type transistor, the driving circuit 20 may decrease the voltage of the control signal by a suitable voltage (e.g., a predetermined voltage) stepwise, and may supply the control signal to the respective bias control lines Bi in correspondence with the plurality of sub light emission periods SEP. In another example, when the first transistor T1 is an N-type transistor, the driving circuit 20 may increase the voltage of the control signal by a suitable voltage (e.g., a predetermined voltage) stepwise, and may supply the control signal to the respective bias control lines Bi in correspondence with the plurality of sub light emission periods SEP.

However, the invention is not limited thereto. For example, the driving circuit 20 may determine a change degree and/or a direction of change of the control signal according to a conductivity type, an operation characteristic, and/or the like of the first transistor T1.

When the last sub light emission period SEP of each light emission period EP is ended, the voltage of the control signal may be changed to a suitable (e.g., predetermined) reference voltage. For example, when the second sub light emission period SEP2 ends, the voltage of the control signal may be changed back to the first voltage V1 or to another suitable reference voltage.

As described above, the threshold voltage $Vt_{(FG)}$ of the first transistor T1 may be changed by changing the voltage of the control signal to the second voltage V2 during the second sub light emission period SEP2. For example, the threshold voltage $Vt_{(FG)}$ of the first transistor T1 may be increased by decreasing the voltage of the control signal to the second voltage V2, so that the increase of the voltage V[N1] of the first node N1 is compensated during the second sub light emission period SEP2. Therefore, the first transistor T1 may supply a uniform or substantially uniform (e.g., a more uniform) driving current $I_{OLED}$ to the light emitting element EL during each light emission period EP when compared to other driving methods.

Figure 10:
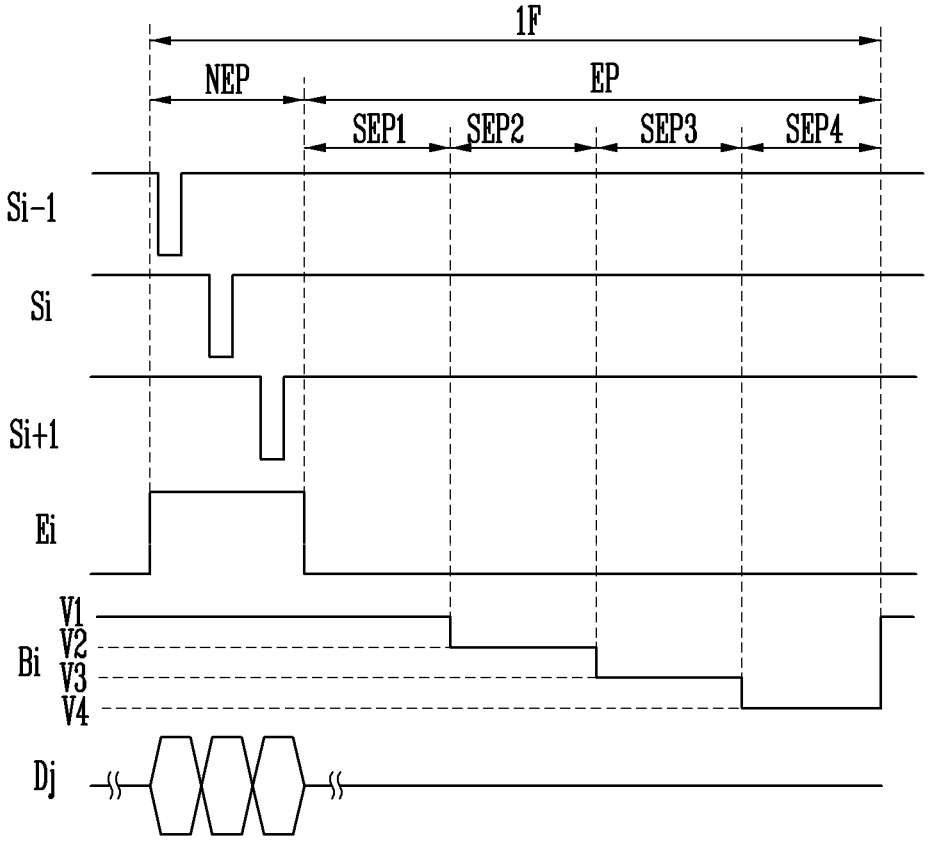
FIG. 10 is a waveform diagram illustrating signals for driving the pixel according to an embodiment of the invention.
Figure 11:
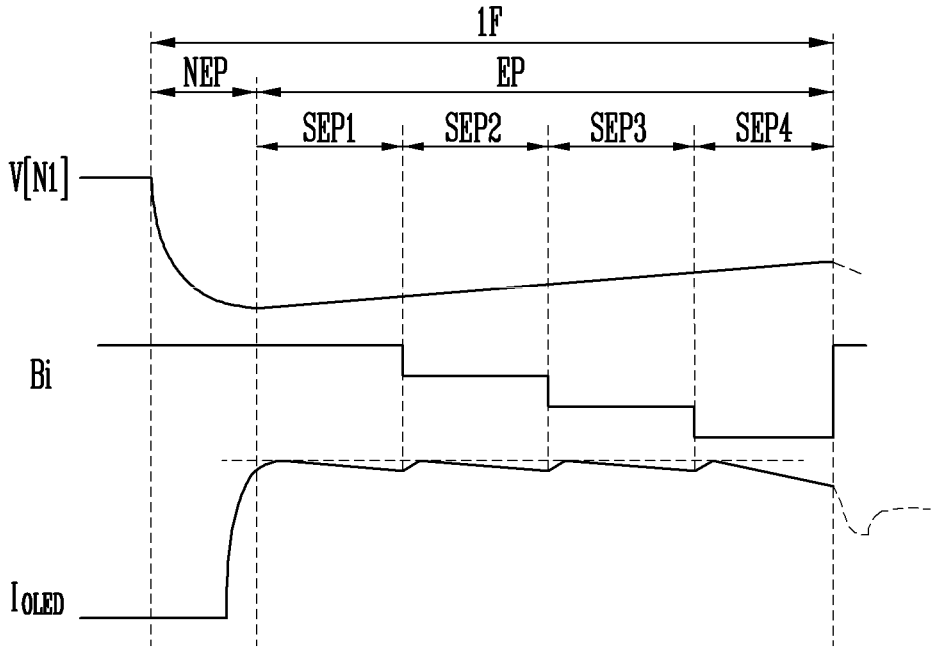
FIG. 11 is a waveform diagram illustrating a driving current of the pixel according to the signals of FIG. 10, in accordance with an embodiment of the invention.

FIG. 10 is a waveform diagram illustrating signals for driving the pixel PXL according to an embodiment of the invention. FIG. 11 is a waveform diagram illustrating a driving current $I_{OLED}$ of the pixel PXL according to the signals of FIG. 10, in accordance with an embodiment of the invention. FIGS. 10 and 11 illustrate a modified embodiment of the embodiment of FIGS. 8 and 9. For example, FIG. 10 illustrates driving signals of the pixel PXL when driven at another frequency of the first range that is less than the reference frequency, for example, a frequency of 15 Hz, and FIG. 11 illustrates changes in the voltage V[N1] of the first node N1 and the driving current IDLED according to the driving signals of FIG. 10. In the following description with reference to the embodiment of FIGS. 10 and 11, redundant descriptions of components, configurations, operations, and/or methods that are the same or substantially the same as (e.g., or similar to) those of the above-described embodiments may not be repeated.

Referring to FIGS. 1 to 11, each light emission period EP may be divided into three or more sub light emission periods SEP. For example, each light emission period EP may be divided into first to fourth sub light emission periods SEP1 to SEP4.

Hereinafter, when referring to a particular one of the sub light emission periods from among the first to fourth sub light emission periods SEP1 to SEP4, the corresponding sub light emission period may be referred to as the "first sub light emission period SEP1", the "second sub light emission period SEP2", the "third sub light emission period SEP3", or the "fourth sub light emission period SEP4". On the other hand, when referring to at least one sub light emission period from among the first to fourth sub light emission periods SEP1 to SEP4 arbitrarily, or when referring to the first to fourth sub light emission periods SEP1 to SEP4 collectively, the first to fourth sub light emission periods SEP1 to SEP4 may be referred to as a "sub light emission period SEP" or "sub light emission periods SEP".

According to an embodiment, the sub light emission periods SEP may be continued for the same or substantially the same time as each other. For example, each of the first to fourth sub light emission periods SEP1 to SEP4 may have the same or substantially the same duration (e.g., be continued for a length of time that is the same or substantially the same as or similar to) that of the light emission period (e.g., each light emission period) EP when driving the pixels PXL at 60 Hz. However, the invention is not limited thereto. For example, in another embodiment, the first to fourth sub light emission periods SEP1 to SEP4 may have different durations (e.g., continuance times) from each other.

According to an embodiment, in the first mode, the driving circuit 20 may supply a control signal having a different voltage to the bias control line Bi in correspondence with the sub light emission periods SEP. For example, the driving circuit 20 may reduce the voltage of the control signal stepwise, and may supply the control signal to the bias control line Bi in correspondence with the first to fourth sub light emission periods SEP1 to SEP4. In another example, the driving circuit 20 may increase the voltage of the control signal stepwise, and may supply the control signal to the bias control line Bi in correspondence with the first to fourth sub light emission periods SEP1 to SEP4.

For example, the driving circuit 20 may supply a control signal having a first voltage V1 to the bias control line Bi during the first sub light emission period SEP1, and may supply a control signal having a second voltage V2 that is less than the first voltage V1 to the bias control line Bi during the second sub light emission period SEP2. In addition, the driving circuit 20 may supply a control signal having a third voltage V3 that is less than the second voltage V2 to the bias control line Bi during the third sub light emission period SEP3, and may supply a control signal having a fourth voltage V4 that is less than the third voltage V3 to the bias control line Bi during the fourth sub light emission period SEP4. However, when the fourth sub light emission period SEP4 ends, the voltage of the control signal may be restored (e.g., changed back) to the first voltage V1 or another suitable reference voltage.

Referring to the embodiments of FIGS. 8 to 11, when driving the pixels PXL at the frequency of the first range that is less than the reference frequency, each light emission period EP is divided into the plurality of sub light emission periods SEP shortly, and the voltage of the control signal that is supplied to each bias control line Bi is changed stepwise in correspondence with the sub light emission periods SEP. In this case, the pixels PXL may receive a control signal having a suitable waveform, for example, such as a waveform having a step shape, during each light emission period EP.

For example, in one or more embodiments of the invention, the threshold voltage $Vt_{(FG)}$ of the first transistor T1 may be changed by changing the voltage of the control signal stepwise so that the variation (e.g., change) of the voltage V[N1] of the first node N1 according to (e.g., due to) the leakage current Ioff or the like may be offset. Therefore, a uniform or substantially uniform (e.g., a more uniform) driving current $I_{OLED}$ may flow through the light emitting element EL by the first transistor T1 during each light emission period EP when compared to other driving methods, and thus, a luminance change of the pixels PXL may be minimized or reduced even when driven by (e.g., at the time of) the low frequency driving.

FIG. 12 is a lookup table LUT illustrating a voltage change of the control signal according to the frequency of the first range, in accordance with an embodiment of the invention. According to an embodiment, the lookup table LUT of FIG. 12 may be stored in the driving circuit 20, and may be applied when the display device 1 is driven in the first mode. For example, the lookup table may be stored in the timing controller 25, and may be used to generate the bias driving control signal BCS.

Referring to FIGS. 1 to 12, the driving circuit 20 may store voltage information of a control signal with respect to each driving frequency of (e.g., belonging to or included in) the first range. For example, the driving circuit 20 may include a lookup table LUT that stores voltage information of a control signal for each of suitable driving frequencies (e.g., predetermined driving frequencies) that are less than the reference frequency (e.g., 60 Hz), for example, driving frequencies that are equal to or less than 30 Hz.

When the frequency of the first range includes a plurality of driving frequencies, the driving circuit 20 may supply a control signal having different voltages and/or waveforms to the pixels PXL with respect to each driving frequency of the first range by using the information (e.g., the voltage information) that is stored in the lookup table LUT. For example, the driving circuit 20 may divide the light emission period of the pixels PXL into different numbers of sub light emission periods with respect to each driving frequency of the first range, and may change the voltage of the control signal stepwise in correspondence with the sub light emission periods. For example, the driving circuit 20 may divide the light emission period EP into a larger number of sub light emission periods as the length (or duration) of the light emission period EP according to each driving frequency of the first range increases (e.g., as the driving frequency decreases), and may output a control signal having a suitable waveform in which a voltage is changed in a step shape or the like in correspondence with the sub light emission periods.

In an embodiment, the driving circuit 20 may divide each light emission period EP into the first sub light emission period SEP1 and the second sub light emission period SEP2 with respect to a driving frequency of 30 Hz, and may supply the control signals having each of the first voltage V1 and the second voltage V2 to the bias control line Bi with respect to the first and second sub light emission periods SEP1 and SEP2. For example, the driving circuit 20 may supply a control signal having 7V to the bias control line Bi during the first sub light emission period SEP1, and may reduce the voltage of the control signal to 6.995 V at a point in time when the first sub light emission period SEP1 ends and the second sub light emission SEP2 begins (e.g., after 0.0167 seconds have passed after each frame 1F or when each light emission period EP has started). In addition, the driving circuit 20 may change the voltage of the control signal back to 7 V at a point in time when the second sub light emission period SEP2 ends (e.g., after 0.0334 seconds have passed after each frame 1F or when each of the light emission period EP has started).

As another example, the driving circuit 20 may divide each light emission period EP into the first, second, third, and fourth sub light emission periods SEP1, SEP2, SEP3, and SEP4 with respect to a driving frequency of 15 Hz, and may supply the control signal having the first voltage V1, the second voltage V2, the third voltage V3, and the fourth voltage V4 to the bias control line Bi during the first, second, third, and fourth sub light emission periods SEP1, SEP2, SEP3, and SEP4, respectively. For example, the driving circuit 20 may supply a control signal having 7 V to the bias control line Bi during the first sub light emission period SEP1, and may reduce the voltage of the control signal to 6.995 V at a point in time when the first sub light emission period SEP1 ends and the second sub light emission SEP2 starts (e.g., after 0.0167 seconds have passed after each frame 1F or when each light emission period EP has started). Similarly, the driving circuit 20 may reduce the voltage of the control signal to 6.990 V at a point in time when the second sub light emission period SEP2 ends (e.g., after 0.0334 seconds have passed after each frame 1F or when each light emission period EP has started), and may reduce the voltage of the control signal to 6.985 V at a point in time when the third sub light emission period SEP3 ends (e.g., after 0.0501 seconds have passed after each frame 1F or when each light emission period EP has started). In addition, the driving circuit 20 may change the voltage of the control signal back to 7 V at a point in time when the last fourth sub light emission period SEP4 ends (e.g., after 0.0668 seconds have passed after each frame 1F or when each light emission period EP has started).

As described above, the driving circuit 20 may change the voltage of the control signal stepwise at the same or different periods from each other during each light emission period EP with respect to each driving frequency of the first range. For example, when driving in the first mode, the driving circuit 20 may change the voltage of the control signal stepwise every 1/60 second during each frame 1F or during the light emission period EP. For example, the driving circuit 20 may change the voltage of the control signal stepwise 60 times during each frame 1F with respect to a driving frequency of 1 Hz.

Therefore, even though the display device 1 is driven at a low frequency that is less than the reference frequency, the driving current $I_{OLED}$ that flows through the pixels PXL may be uniformly maintained or substantially maintained during each light emission period EP. Therefore, image quality of the display device 1 may be improved by uniformly maintaining or substantially maintaining the luminance of the pixels PXL, and/or preventing or reducing flicker during each light emission period EP.

Figure 13:
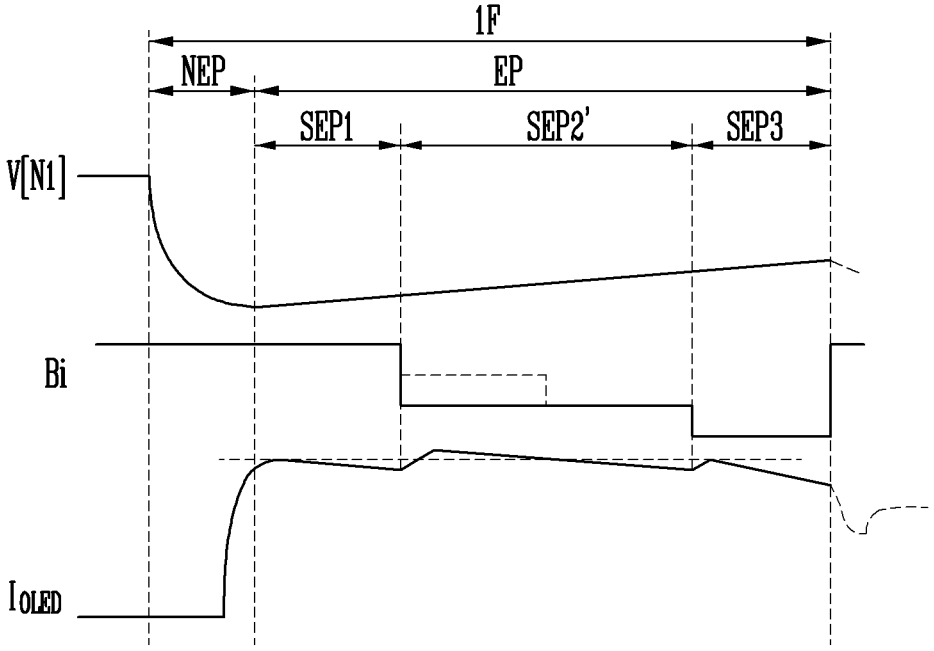
FIG. 13 is a waveform diagram illustrating a driving current of the pixel according to various driving signals, in accordance with an embodiment of the invention.

FIG. 13 is a waveform diagram illustrating a driving current $I_{OLED}$ of the pixel PXL according to various driving signals, in accordance with an embodiment of the invention. In addition, FIG. 14 is a lookup table LUT' illustrating a voltage change of the control signal according to the frequency of the first range, in accordance with an embodiment of the invention. For example, the embodiment of FIGS. 13 and 14 illustrate a modified embodiment of the embodiment of FIGS. 10 to 12. In the following description with reference to the embodiment of FIGS. 13 and 14, redundant descriptions of components, configurations, operations, and/or methods that are the same or substantially the same as (e.g., or similar to) those of the above-described embodiments may not be repeated.

Referring to FIGS. 13 and 14, at least some sub light emission periods according to the embodiment of FIGS. 10 to 12 may be combined (e.g., integrated). For example, the waveform of the control signal that is supplied to each bias control line Bi may be simplified by incorporating at least some sub light emission periods of at least some driving frequencies of the first range.

In an embodiment, as shown in FIG. 13, two or more sub light emission periods may be combined (e.g., integrated), with respect to the remaining sub light emission periods (e.g., intermediate sub light emission periods), except for a first sub light emission period and the last sub light emission period of each light emission period EP. In other words, two or more sub light emission periods (e.g., two or more intermediate sub light emission periods) may be combined (e.g., integrated) with each other, except for the first sub light emission period and the last sub light emission period of the light emission period EP. For example, when driving the pixels PXL at 15 Hz, each light emission period EP may be divided into three sub light emission periods, for example, a first sub light emission period SEP1, a second sub light emission period SEP2', and a third sub light emission period SEP3.

According to an embodiment, the second sub light emission period SEP2' that is positioned at (e.g., in) the middle from among the first to third sub light emission periods SEP1, SEP2', and SEP3 may be continued for a longer duration (e.g., a longer time) than that of each of the other remaining sub light emission periods (e.g., than each of the first sub light emission period SEP1 and the third sub light emission period SEP3). In other words, the second sub light emission period SEP2' may have a duration that is longer than that of each of the first and third sub light emission periods SEP1 and SEP3. In addition, at an entry (e.g., or a start) time point of the second sub light emission period SEP2', the driving circuit 20 may change the voltage of the control signal to have a greater amplitude than an amplitude of the control signal at an entry (or a start) time point of the remaining sub light emission periods. In other words, the driving circuit 20 may change the amplitude of the voltage of the control signal to be greater at the start point of the second sub light emission period SEP2' than at the start point of the other remaining sub light emission periods. Therefore, the driving current IDLED may be prevented or substantially prevented from being greatly reduced (e.g., reduced by a large amount) during the second sub light emission period SEP2'.

In another embodiment, as shown in FIG. 14, with respect to the driving frequency of the first range, at least two voltage change time points may be paired and integrated into one voltage change time point with respect to the remaining voltage change time points (e.g., intermediate voltage change time points), except for the first and last time points when the voltage of the control signal is changed. In other words, two or more voltage change time points (e.g., two or more intermediate voltage change time points) may be combined with each other, except for the first and last voltage change time points. For example, with respect to a driving frequency that is less than or equal to 15 Hz, two voltage change time points (e.g., two intermediate voltage change time points) may be paired and integrated (e.g., combined) into one voltage change time point except for a first voltage change time point and the last voltage change time point.

According to the embodiments of FIGS. 13 and 14, at least some sub light emission periods according to the embodiment of FIGS. 10 to 12 are integrated (e.g., combined). Therefore, the lookup table LUT' may be simplified, and/or power consumption may be reduced.

However, a method of integrating (e.g., combining) the sub light emission periods SEP is not limited to the embodiments of FIGS. 13 and 14. For example, in addition to the embodiments of FIGS. 13 and 14, in other embodiments, at least some sub light emission periods SEP may be integrated using various suitable methods as would be known to those skilled in the art.

Figure 15:
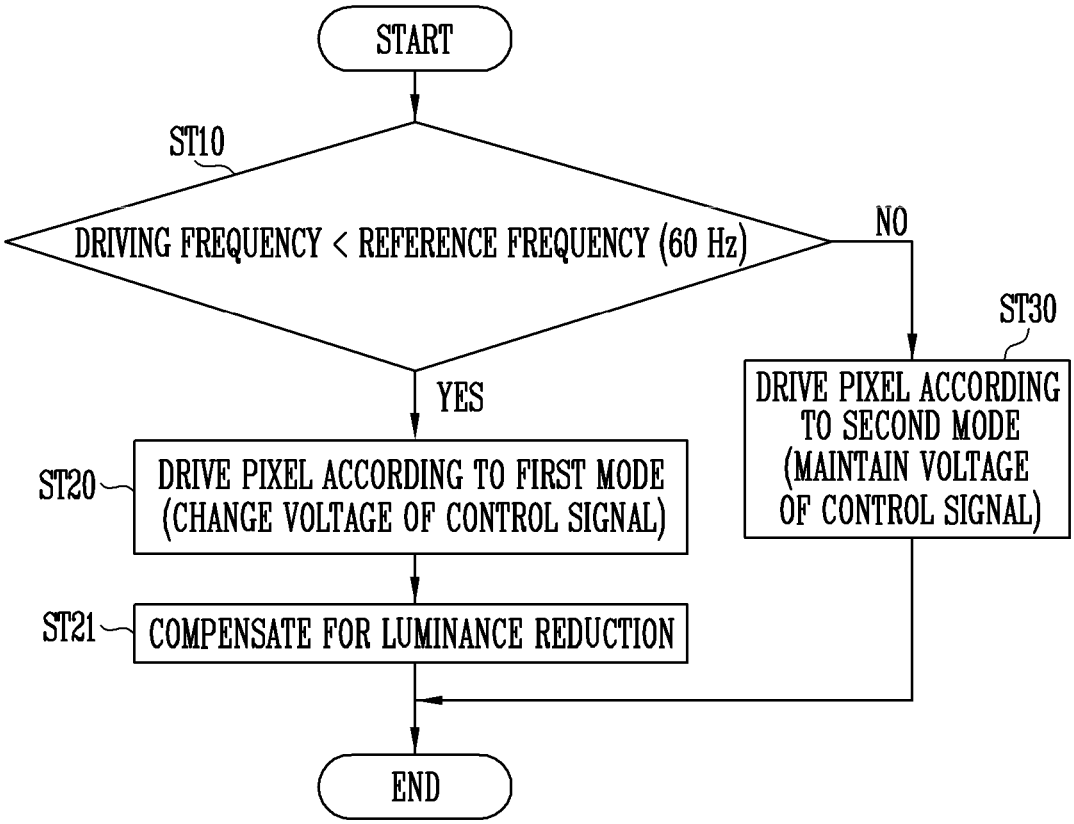
FIG. 15 is a flowchart illustrating a method of driving the display device according to an embodiment of the invention.

FIG. 15 is a flowchart illustrating a method of driving the display device 1 according to an embodiment of the invention.

Referring to FIGS. 1 to 15, the display device 1 according to an embodiment includes the pixel PXL that includes the driving transistor (e.g., the first transistor T1) having the dual gate structure. For example, each pixel PXL disposed at (e.g., in or on) the display area 10 includes the first transistor T1 including the first gate electrode GE1 and the second gate electrode GE2. In addition, the display device 1 may be driven at a frequency having a suitable range (e.g., a predetermined range), and may be driven in different methods according to each driving frequency based on a suitable or predetermined reference frequency (e.g., 60 Hz).

According to an embodiment, when each driving frequency is less than the reference frequency, the display device 1 may drive each pixel PXL in the first mode. For example, the display device 1 may change the voltage of the control signal supplied to each bias control line Bi stepwise during each light emission period EP in the first mode.

On the other hand, when each driving frequency is greater than or equal to the reference frequency, the display device 1 may drive each pixel PXL in the second mode. For example, the display device 1 may maintain or substantially maintain (e.g., continuously maintain) the voltage of the control signal that is supplied to each bias control line Bi to be constant or substantially constant in the second mode.

Referring to FIG. 15, the method starts, and in order to determine a driving mode of the display device 1, a driving frequency of the pixels PXL (e.g., a driving frequency of the display device 1) is determined ((ST10), also referred to as a "driving frequency determination step"). For example, the driving frequency of the pixels PXL may be compared with a suitable reference frequency (e.g., a predetermined reference frequency, for example, 60 Hz) at operation ST10, and the driving mode of the display device 1 is determined according to a comparison result (e.g., based on the comparison).

For example, when the driving frequency of the pixels PXL is less than the reference frequency (e.g., YES at operation ST10), the first mode is executed to change the voltage of the control signal (ST20). For example, when the driving frequency is within (e.g., belongs to the frequency of) the first range that is less than the reference frequency, the pixels PXL may be driven in the first mode while changing the voltage of the control signal, which is supplied to each bias control line Bi, stepwise at operation ST20.

According to an embodiment, driving the pixels PXL in the first mode may include supplying the data signal to the pixels PXL, and emitting the pixels PXL. For example, the pixel PXL may emit light according to the first gate voltage applied to the first gate electrode GE1 of the driving transistor while supplying the data signal to the first gate electrode GE1 of the driving transistor (e.g., the first transistor T1) of each pixel PXL during each non-light emission period NEP, and supplying (e.g., sequentially supplying) the control signal having the first voltage V1 and the second voltage V2 to the second gate electrode GE2 of the driving transistor through the bias control line Bi during each light emission period EP subsequently to the non-light emission period NEP.

In an embodiment of the invention, the luminance reduction due to the low frequency driving may be compensated by driving the pixels PXL in the first mode (ST21). For example, as described above, the change of the voltage V[N1] of the first node N1 due to the leakage current may be compensated by changing the voltage of the control signal stepwise during each light emission period EP, which is supplied to the second gate electrode GE2 of the driving transistor. Therefore, the luminance reduction of the pixels PXL due to the low frequency driving may be compensated at operation ST21. Operations ST20 and ST21 may also be referred to as a "pixel driving and luminance reduction compensation step according to the first mode."

In an embodiment, the frequency of the first range may include a plurality of driving frequencies. In this case, the display device 1 may divide the light emission period EP of each pixel PXL into a different number of sub light emission periods SEP with respect to each driving frequency of the first range, and may change the voltage of the control signal stepwise in correspondence with the sub light emission periods SEP. For example, the display device 1 may divide the light emission period EP into a larger number of sub light emission periods as the light emission period EP according to each driving frequency range increases (e.g., as the driving frequency decreases), and may change the voltage of the control signal stepwise in correspondence with the sub light emission periods SEP.

Therefore, a uniform or substantially uniform driving current IDLED may flow through the pixel PXL during each light emission period EP, regardless of the driving frequency. For example, even when the pixels PXL are driven at a low frequency of the first range (e.g., even at an ultra-low frequency of 1 Hz), the luminance of the pixels PXL may be maintained or substantially maintained (e.g., uniformly maintained) during each light emission period EP.

On the other hand, when the driving frequency of the pixels PXL is greater than or equal to the reference frequency (e.g., NO at operation ST10), the second mode is executed to maintain or substantially maintain the voltage of the control signal at a constant voltage or level (ST30). For example, when the driving frequency is in (e.g., belongs to) the second range that is greater than or equal to the reference frequency, the control signal of the constant voltage may be supplied (e.g., continuously supplied) to the second gate electrode GE2 of each driving transistor during the light emission period EP of the pixels PXL at operation ST30. In other words, when each light emission period EP is sufficiently short according to the high frequency driving of the pixels PXL, the control signal having a suitable voltage (e.g., a DC voltage) may be supplied to each bias control line Bi. Therefore, unnecessary power consumption may be prevented or reduced. Operation ST30 may also be referred to as a "pixel driving step according to the second mode."

While one or more exemplary embodiments of the present invention are described with reference to the attached drawings, it should be understood that embodiments described herein should be considered in a descriptive sense only and not for purposes of limitation. Accordingly, those with ordinary skill in the art to which the present invention pertains will understand that various aspect and features of the present invention may be modified without departing from the spirit and scope of the present invention as defined in the following claims, and their equivalents.

What is claimed is:

1. A display device comprising:

a pixel at a display area, the pixel comprising:

a light emitting element connected between a first power source and a second power source;

a first transistor connected between the first power source and the light emitting element to control a driving current, the first transistor comprising a first gate electrode connected to a first node and a second gate electrode connected to a bias control line; and at least one switching transistor electrically connected to a data line and the first node, the at least one switching transistor comprising a gate electrode connected to a scan line; and a driving circuit configured to drive the pixel according to a driving frequency, wherein the driving circuit is configured to drive the pixel in a first mode when the driving frequency is in a first range, and to sequentially supply a control signal having a first voltage and a second voltage different from the first voltage to the bias control line during a light emission period of the pixel in the first mode.

2. The display device according to claim 1, wherein the first range comprises a frequency that is less than 60 Hz.

3. The display device according to claim 1, wherein the driving circuit is configured to drive the pixel in a second mode when the driving frequency is in a second range that is greater than the first range, and to supply a control signal having a constant voltage to the bias control line when in the second mode.

4. The display device according to claim 3, wherein the second range comprises a frequency that is greater than or equal to 60 Hz.

5. The display device according to claim 1, wherein:

the display area comprises:

a plurality of scan lines;

a plurality of bias control lines;

a plurality of data lines; and a plurality of pixels connected to the scan lines, the bias control lines, and the data lines; and the driving circuit comprises:

a scan driver to supply a scan signal to the scan lines;

a control line driver to supply the control signal to the bias control lines;

a data driver to supply a data signal to the data lines; and a timing controller to control the scan driver, the control line driver, and the data driver.

6. The display device according to claim 5, wherein the bias control lines are commonly connected to pixels of each horizontal line.

7. The display device according to claim 6, wherein the control line driver is configured to sequentially supply the control signal having the first voltage and the second voltage to the bias control lines connected to the pixels during the light emission period of the pixels of each horizontal line in the first mode.

8. The display device according to claim 7, wherein the timing controller is configured to divide the light emission period of the pixels into a plurality of sub light emission periods when in the first mode, and to control the control line driver to change the voltage of the control signal corresponding to the sub light emission periods.

9. A display device comprising:

a pixel at a display area, the pixel comprising:

a light emitting element connected between a first power source and a second power source;

a first transistor connected between the first power source and the light emitting element to control a driving current, the first transistor comprising a first gate electrode connected to a first node and a second gate electrode connected to a bias control line; and at least one switching transistor electrically connected to a data line and the first node, the at least one switching transistor comprising a gate electrode connected to a scan line; and a driving circuit configured to drive the pixel according to a driving frequency, wherein the driving circuit is configured to drive the pixel in a first mode when the driving frequency is in a first range, and to sequentially supply a control signal having a first voltage and a second voltage to the bias control line during a light emission period of the pixel in the first mode, and wherein the driving circuit is configured to divide the light emission period of the pixel into a plurality of sub light emission periods comprising a first sub light emission period and a second sub light emission period when in the first mode, and to supply the control signal having different voltages to the bias control line during each of the sub light emission periods.

10. The display device according to claim 9, wherein the first transistor is a P-type transistor, and the driving circuit is configured to decrease the voltage of the control signal stepwise, and to supply the control signal to the bias control line corresponding to the sub light emission periods.

11. The display device according to claim 9, wherein the first range comprises a plurality of driving frequencies, and the driving circuit is configured to divide the light emission period of the pixel into a different number of sub light emission periods for each of the driving frequencies of the first range, and to change the voltage of the control signal stepwise corresponding to the sub light emission periods.

12. The display device according to claim 11, wherein the driving circuit comprises a lookup table to store voltage information of the control signal for each of the driving frequencies.

13. The display device according to claim 9, wherein the driving circuit is configured to increase or decrease the voltage of the control signal by a voltage amount stepwise, and to supply the control signal to the bias control line corresponding to the sub light emission periods.

14. The display device according to claim 9, wherein at least one of the sub light emission periods has a duration that is longer than that of at least one other remaining sub light emission periods, and the driving circuit is configured to change the voltage of the control signal at a start time of the at least one of the sub light emission periods to have an amplitude that is greater than that of the control signal at a start time of the at least one other remaining sub light emission periods.

15. A method of driving a display device comprising a pixel comprising a driving transistor having a dual gate structure, the method comprising:

determining a driving frequency of the pixel; and driving the pixel in a first mode when the driving frequency is in a first range, wherein the driving of the pixel in the first mode comprises:

supplying a data signal to a first gate electrode of the driving transistor; and illuminating the pixel according to a voltage applied to the first gate electrode of the driving transistor while sequentially supplying a control signal having a first voltage and a second voltage different from the first voltage to a second gate electrode of the driving transistor.

16. The method according to claim 15, wherein the first range comprises a frequency that is less than 60Hz.

17. The method according to claim 15, wherein the first range comprises a plurality of driving frequencies, a light emission period of the pixel is divided into a different number of sub light emission periods for each of the driving frequencies of the first range, and the voltage of the control signal is changed stepwise corresponding to the sub light emission periods.

18. The method according to claim 17, wherein the light emission period of the pixel is divided into a greater number of sub light emission periods as the light emission period according to each of the driving frequencies is increased.

19. The method according to claim 15, further comprising:

supplying the control signal having a constant voltage to the second gate electrode of the driving transistor during a light emission period of the pixel when the driving frequency is in a second range that is greater than the first range.

20. The method according to claim 19, wherein the second range comprises a frequency that is greater than or equal to 60 Hz.

* * * * *